US005227850A

United States Patent [19]

Sato et al.

[11] Patent Number: 5,227,850

[45] Date of Patent: Jul. 13, 1993

[54] ELECTROPHOTOGRAPHIC PLATE-MAKING APPARATUS

[75] Inventors: Yoshimitsu Sato; Hisao Oh-ishi; Akira Yoda, all of Kanagawa, Japan

[73] Assignee: Fuji Photo Film Co., Ltd., Kanagawa, Japan

[21] Appl. No.: 778,483

[22] Filed: Oct. 17, 1991

[30] Foreign Application Priority Data

Oct. 19, 1990 [JP] Japan ..... 2-282292

[51] Int. Cl.[5] ..... G03G 15/00

[52] U.S. Cl. ..... 355/271; 346/157; 355/277; 355/326

[58] Field of Search ..... 355/271, 274, 277, 279, 355/326, 327, 328; 346/160, 157; 358/75

[56] References Cited

U.S. PATENT DOCUMENTS

| | | | |
|---|---|---|---|
| 4,187,774 | 2/1980 | Iwasa et al. | 101/1 |
| 4,475,239 | 10/1984 | van Raamsdonk | 382/57 |
| 4,788,572 | 11/1988 | Slayton et al. | 355/271 X |
| 4,882,593 | 11/1989 | Touma et al. | 346/111 |
| 4,903,067 | 2/1990 | Murayama et al. | 346/160 |
| 4,912,491 | 3/1990 | Hoshino et al. | 346/160 |
| 4,937,664 | 6/1990 | Chiku et al. | 358/75 |
| 5,160,946 | 11/1992 | Hwang | 346/157 |

FOREIGN PATENT DOCUMENTS

| | | |
|---|---|---|
| 62-81681 | 4/1987 | Japan . |
| 63-163384 | 7/1988 | Japan . |

*Primary Examiner*—A. T. Grimley
*Assistant Examiner*—T. A. Dang
*Attorney, Agent, or Firm*—Sughrue, Mion, Zinn, Macpeak & Seas

[57] ABSTRACT

An electrophotographic plate-making apparatus in which a light beam is applied to the surface of a photoconductive sensitive material from a light-beam applying device so as to form an image and a register mark on the surface of the sensitive material the image and the register mark are transferred onto an outer peripheral surface of an intermediate transfer material, a recording material and the intermediate transfer material are moved while the outer peripheral surface of the intermediate transfer while the outer peripheral surface of the are brought into contact with each other, the movement of the recording material and the intermediate transfer material is controlled by detecting the transferred register mark, thereby to transfer the image onto the recording material with high positional accuracy. By forming the register mark through light-beam scanning, it is possible to provide the photosensitive material with the register mark efficiently and reliably, so that the image can be transferred onto the recording material with high positional accuracy.

23 Claims, 15 Drawing Sheets

FIRST REVOLUTION

ELECTROPHOTOGRAPHIC PLATE-MAKING APPARATUS

BACKGROUND OF THE INVENTION

1. Field of the Invention

The present invention relates to an electrophotographic plate-making apparatus for transferring an image formed on a surface of a photosensitive material onto a recording material via an intermediate transfer material.

2. Description of the Related Art

As a method for making a machine plate for printing in an electrophotographic process, a method is known in which an image is formed on a photosensitive material by using a plate material coated with the photosensitive material, and the surface of the photosensitive material is then subjected to etching (Japanese Patent Application Laid-Open No. 63-163384). With this method, the accuracy of the position at which the image is formed is excellent since the plate material on which the image formed is subjected to etching. However, this method has a drawback in that high-alkali etching is required, so that the process is complicated and the running cost is high. As a method which is free from this drawback, a method is known in which an image formed on the photosensitive material is temporarily transferred onto an intermediate transfer material, and the image formed on the intermediate transfer material is further transferred onto a machine plate (Japanese Patent Application Laid-Open Nos. 62-81681 and 63-34572).

However, with the method using the intermediate transfer material, although the running cost does not become high since high-alkali etching is not required, it has been difficult to secure high positional accuracy required in color plate making and the like due to the large number of transfer processes. In particular, in a case where color-printing machine plates are made, it is necessary to make machine plates respectively corresponding to a black image, a yellow image, a magenta image, and a cyan image, so that high positional accuracy is required for the images formed on the respective machine plates.

In addition, at the time of transferring an image onto the intermediate transfer material and the machine plate, there have been cases where even if the positions of the intermediate transfer material and the machine plate are controlled by a high-accuracy encoder, the image is formed the proper position offset from a predetermined position on the intermediate transfer material due to the thermal expansion of the intermediate transfer material itself, the elongation of the transfer material, and the like. As a result, there have been cases where the image is not formed by the proper position at when the image is transferred onto the plate material.

As a method of forming an image on a machine plate with high positional accuracy, it has been the practice in the conventional field of printing to provide a register mark on an original plate at the time of preparing the original plate and to form the image on the machine plate by using the register mark as an index for registration. However, since the provision of the register mark is effected each time the original plate is made, a process for this purpose has had to be provided separately.

Meanwhile, as another method of forming an image on a machine plate with high positional accuracy, at the time of transferring the image formed on the photosensitive material onto the transfer material, it has been the practice in the conventional field of copying apparatus to eliminate the offsetting of colors by strictly effecting the registration of the photosensitive material with respect to the transfer material at the time of starting transfer. However, strict registration requires a complicated process.

Furthermore, in an electrophotographic plate-making apparatus using the intermediate transfer material, a shortcoming has been encountered with the durability of the intermediate transfer material since the image is transferred by bringing its surface into contact with the photosensitive material and the machine plate. In addition, replacing the intermediate transfer material is troublesome.

SUMMARY OF THE INVENTION

Accordingly, it is an object of the present invention to provide an electrophotographic plate-making apparatus capable of transferring an image at high positional accuracy even if the image is transferred onto a machine plate using an intermediate transfer material.

Another object of the present invention is to provide an electrophotographic plate-making apparatus capable of transferring an image at high positional accuracy by simply effecting the provision of a register mark and without requiring a complicated process.

Still another object of the present invention is to provide an electrophotographic plate-making apparatus having an intermediate transfer drum making it possible to readily replace an intermediate transfer material when the intermediate transfer material has become unusable.

In accordance with the present invention, the electrophotographic plate-making apparatus for recording an image on a recording material is characterized by comprising: a photoconductive sensitive material; light-beam applying means for forming an image and a mark indicating a position of an image area by applying a light beam onto a surface of the photoconductive sensitive material; movable intermediate transfer means onto a surface of which the image and the mark formed on the photoconductive sensitive material are transferred; moving means for moving the recording material; detecting means for detecting the mark transferred onto the intermediate transfer means; and control means for controlling at least one of the operation of the moving means and the movement of the intermediate transfer means on the basis of a detection signal of the detecting means in such a manner that the image area and an area of the recording material where the image is to be recorded will be registered with each other, and for controlling the operation of the moving means and the movement of the intermediate transfer means while the surface of the intermediate transfer means and the recording material are brought into contact with each other, so as to effect the transfer of the image transferred onto the surface of the intermediate transfer means onto the recording material.

In accordance with a first aspect of the invention, an image and a mark indicating a boundary between an image area and a non-image area are formed by applying a light beam to the surface of a photoconductive sensitive material by means of the light-beam applying means. The image and the mark indicating a boundary between the image area and the non-image area, which are formed on the surface of the photoconductive sensitive material, are transferred onto the outer peripheral surface of the intermediate transfer material. Furthermore, at the time when the image transferred onto the outer peripheral surface of the intermediate transfer material is transferred onto the recording material, the image transferred onto the outer peripheral surface of the intermediate transfer material is transferred onto the recording material while at least one of the recording material and the intermediate transfer material is being moved with the outer peripheral surface of the intermediate transfer material and the recording material being brought into contact with each other by the moving means.

At this juncture, the mark indicating a boundary between the image area transferred onto the outer peripheral surface of the intermediate transfer material and the non-image area is detected by the detecting means, and the moving means is controlled on the basis of the detection signal of the detecting means in such a manner that the image area of the intermediate transfer material and the area of the recording member where the image is to be recorded will be registered with each other. Accordingly, it is possible to transfer the image on the intermediate transfer material onto the recording material by always registering the image area of the intermediate transfer material with the area of the recording material where the image is to be recorded In accordance with a second aspect of the invention, control of the moving means is effected by the control means on the basis of the position of the detecting means. Accordingly, if the detecting means is fixedly arranged, control by the control means is facilitated.

In accordance with a third aspect of the invention, the mark is not transferred onto the recording material, and only the image is transferred onto the recording material itself.

In accordance with a fourth aspect of the invention, since a plurality of marks are formed at predetermined intervals along the moving direction, the detecting means detects the positions of these marks and a time difference detected with respect to the marks. The control means calculates the moving velocity of the intermediate transfer material on the basis of a predetermined distance between the marks, and the control means is capable of controlling the moving means on the basis of the calculated value and the detected positions of the marks in such a manner that the image area of the intermediate transfer material and the area of the recording material where the image is to be recorded will be registered with each other. Accordingly, it is possible to transfer the image on the intermediate transfer material onto the recording material by always registering the image area of the intermediate transfer material with the area of the recording material where the image is to be recorded In accordance with a fifth aspect of the invention, since the detecting means is constituted by an image sensor, the positions of the marks and the moving velocities of the marks can be detected simultaneously. On the basis of information obtained by the detecting means, the control means is capable of controlling the moving means in such a manner that the image area of the intermediate transfer material will be registered with the area of the recording material where the image is to be recorded.

In accordance with a sixth aspect of the invention, the image and the register marks formed on the photosensitive material are transferred onto an intermediate transfer material held around an outer peripheral portion of an intermediate transfer drum. At the same time as the recording material is moved in a tangential direction of the intermediate transfer drum by a conveying means, the rotating drum is rotated, and the transfer of the image from the intermediate transfer material onto the recording material is effected. At the time of this transfer, the position of the recording material and the position of the register mark on the intermediate transfer material are detected by the detecting means, and the control means control at least one of the conveying means and the intermediate transfer drum on the basis of the result of detection, and the image transferred onto the intermediate transfer material can be transferred to a predetermined position on the recording material.

In accordance with a seventh aspect of the invention, the intermediate transfer drum is constituted by a hollow member formed of a light-transmitting material, and the detecting means for optically detecting the positions of the registration mark and the recording material is disposed inside the intermediate transfer drum. Accordingly, since the detecting means is capable of detecting the positions of the mark and the recording material from inside the intermediate transfer drum orthogonally with respect to the advancing direction, detection accuracy is excellent.

In accordance with an eighth aspect of the invention, the detecting means is disposed in the conveying means in such a manner that a forward end of the recording material in a moving direction thereof will fall under a range of detection. Accordingly, since the detecting means is capable of detecting the positions of the recording material and the mark in close proximity thereto orthogonally with respect to the advancing direction, detection accuracy is excellent.

In accordance with a ninth aspect of the invention, the intermediate transfer material has a layered member including an electrically conductive layer provided on a film-like base, and an insulating layer formed on an upper surface of the electrically conductive layer. This electrically conductive layer is electrically connected to an applying means for applying a bias voltage and a changeover means for changing over the polarity of the bias voltage. Accordingly, when an image is transferred from the photosensitive material, the polarity of the bias voltage is changed over by the changeover means, so that a voltage of an opposite polarity to that of the charged image is applied to the electrically conductive layer. In addition, when the image is transferred from the intermediate transfer material onto the recording layer, the polarity of the bias voltage is changed over by the changeover means, so that a voltage of the same polarity as that of the image is applied to the electrically conductive layer.

In the manner described above, the image is transferred from the photosensitive material onto the intermediate transfer material, and is further transferred from the intermediate transfer material onto the image recording material.

Furthermore, in the event that a portion of the intermediate transfer material held around the outer peripheral portion of the intermediate transfer drum and used for transfer has become deteriorated, the portion of the intermediate transfer material held around the outer peripheral portion is replaced with a portion of the intermediate transfer material located inside the intermediate transfer drum by a replacing means As described above, in accordance with the first to fifth aspects of the invention, as the mark indicating a boundary between the image area transferred onto the intermediate transfer material and the non-image area is detected by the detecting means, the control means is capable of controlling the moving means on the basis of the detection signal of the detecting means in such a manner that the image area of the intermediate transfer material and the area of the recording material where the image is to be recorded will be registered with each other Accordingly, it is possible to obtain an advantage in that the image on the intermediate transfer material can be transferred onto the recording material by always registering the image area of the intermediate transfer material with the area of the recording material where the image is to be recorded.

As described above, in accordance with the sixth to eighth aspects of the invention, the position of the register mark transferred onto the intermediate transfer material and the position of recording material are detected simultaneously by the detecting means, and at least one of the conveying means and the intermediate transfer drum is controlled by the control means on the basis of the two items of information. Accordingly, the image transferred onto the intermediate transfer material can be transferred to a predetermined position on the recording material with excellent accuracy.

In accordance with a ninth aspect of the invention, an outstanding advantage is obtained in that in a case where the intermediate transfer material has deteriorated due to use over long periods of time, the portion of the intermediate transfer material located around the outer peripheral portion of the intermediate transfer drum can be readily replaced with a portion thereof located inside the intermediate transfer drum.

The above and other objects, features and advantages of the invention will become more apparent from the following detailed description of the invention when read in conjunction with the accompanying drawings.

DESCRIPTION OF THE PREFERRED EMBODIMENTS

Figure 1:
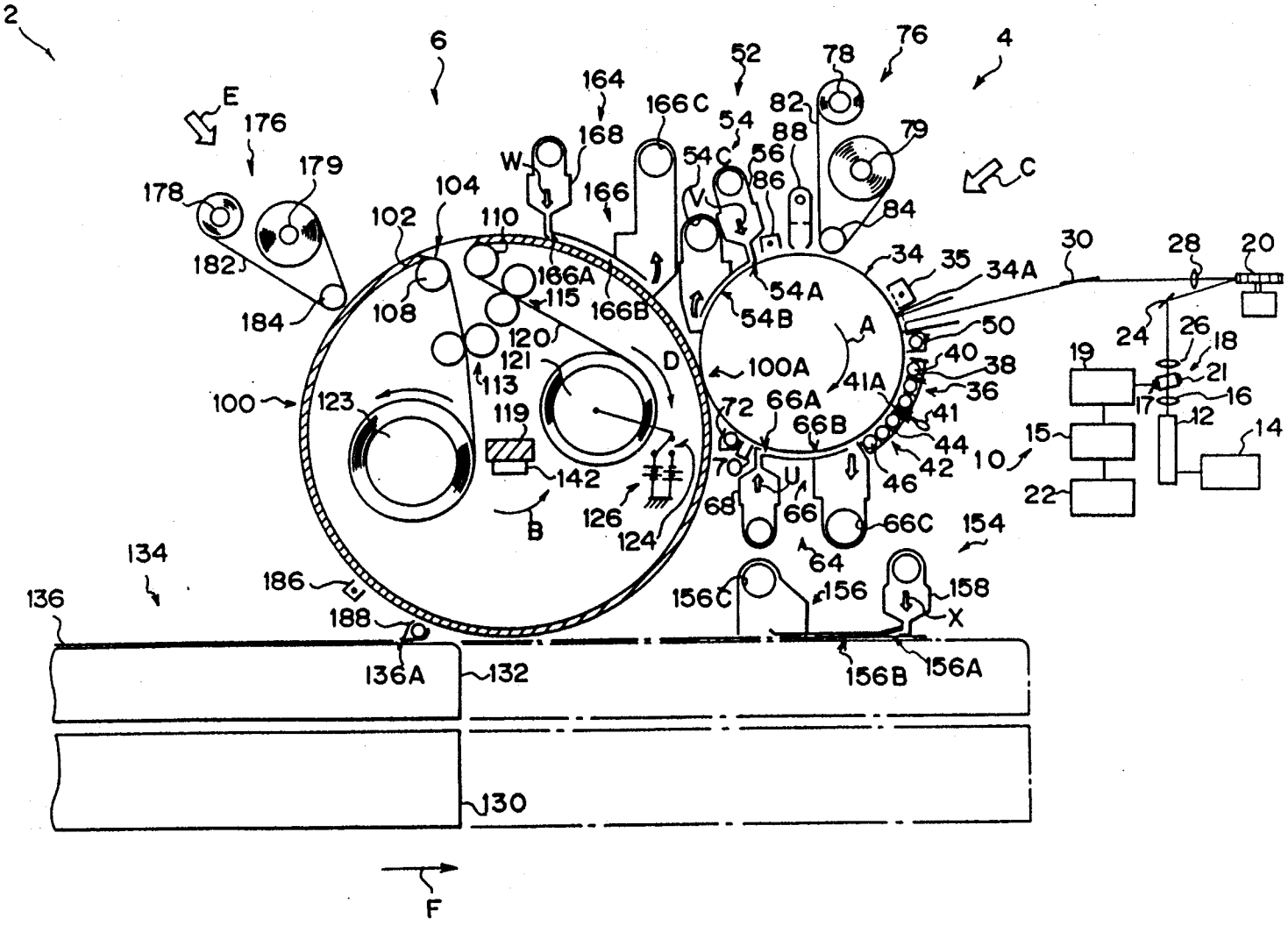
FIG. 1 is a schematic diagram illustrating the layout of various processing portions and an image sensor which constitute an electrophotographic plate-making apparatus in accordance with a first embodiment.

Referring now to FIGS. 1 to 4, a description will be given of a first embodiment of the present invention. FIG. 1 shows an electrophotographic plate-making apparatus 2 in accordance with a first embodiment of the present invention. This electrophotographic plate-making apparatus 2 comprises a photosensitive unit 4, an intermediate unit 6, and a machine-plate conveying stage 134 serving as a moving means.

An exposure portion 10 constituting a part of the photosensitive unit 4 includes the following component parts: a semiconductor laser 12 serving as a light-beam applying means; a power source 14 for supplying electric power to the semiconductor laser 12; condenser lenses 16, 26; a scanning lens 28; reflection mirrors 24, 30; a driver 19; a multi acoustic optical modulator (AOM) 18 connected to the driver 19 and adapted to divide an incident laser beam into a plurality of laser beams in correspondence with the frequencies of incident ultrasonic waves; a polygon mirror 20; and a memory 15 serving as a storage means for recording image information supplied from a host computer 22.

The multi AOM 18 has on its opposite surfaces a transducer 17 for outputting ultrasonic waves in correspondence with high-frequency signals inputted thereto and a sound absorbing material 21 for absorbing the ultrasonic waves. The transducer 17 is connected to the driver 19 for driving the multi AOM 18. As the semiconductor laser 12, it is possible to use, for instance, an Al-Ga-As laser. A laser beam emitted from the semiconductor laser 12 is applied to the multi AOM 18 via the condenser lense 16. In addition, high-frequency signals generated in correspondence with the image information stored in the memory 15 are supplied to the multi AOM 18. A laser beam is diffracted in varying directions corresponding to the frequencies of the ultrasonic waves by means of the ultrasonic waves outputted by the transducer 17 in correspondence with the high-frequency signals. This laser beam is condensed by the condenser lens 26, and is made incident upon the polygon mirror 20 rotating at high speed via the reflection mirror 24. The laser beam reflected by the polygon mirror 20 is applied to an image-forming area of the surface of a photosensitive drum 34 via the scanning lens 28 and the reflection mirror 30. In this embodiment, since the multi AOM is used, the image-forming area is simultaneously scanned with a plurality of (for example, eight) laser beams.

The photosensitive drum 34 is connected to an unillustrated driving means, and is rotated clockwise in FIG. 1 (in the direction of arrow A in FIG. 1). An angle of rotation of the photosensitive drum 34 (the rotation of the photosensitive drum 34 from its home position) is detected by a known photosensitive-drum rotational-position detector (not shown), and its information is inputted to the host computer 22, as required. A photosensitive material 34A serving as a photoconductive sensitive material is provided on the outer peripheral surface of the photosensitive drum 34 where the laser beam is made incident upon the photosensitive material 34A. Although the dark decay of this amorphous silicon is fast, since it can be used repeatedly, the amorphous silicon is suitable for this embodiment.

A corona charging device 35 serving as a charging means is disposed upstream, as viewed in the rotating direction of the photosensitive material 34A, of a position in which the aforementioned laser beam is made incident upon the photosensitive material 34A. This corona charging device 35 has a corona wire and a grid wire, and the corona charging device 35 is connected to a DC power source via an unillustrated changeover switch. As a result, the photosensitive drum 34 prior to the formation of an electrostatic latent image is rotated clockwise in FIG. 1 after the surface of the photosensitive material 34A is uniformly charged positive by the corona charging device 35. The portion of the photosensitive 34A upon which the laser beam is made incident becomes electrically conductive, and the charges on the surface are destroyed, thereby allowing an electrostatic latent image to be formed on the surface of the photosensitive material 34A.

A prewetting device 50 is disposed downstream of the position where the laser beam is made incident upon the photosensitive material 34A (i.e., downstream of the incident position in the rotating direction of the photosensitive drum 34). The prewetting device 50 applies the carrier solution, i.e., a dispersion medium for a liquid developer to the photosensitive material 34A, for the purposes of preventing adhesion of a toner to a non-image portion and improving the transferability of a toner image onto a transfer material.

A developer unit 36 is disposed downstream of the prewetting device 50 as viewed in the rotating direction of the photosensitive drum 34. The developer unit 36 has a box whose upper side is open, and a liquid developer 38 is accommodated in the box. This liquid developer generally comprises a carrier solution, a coloring agent for forming toner particles, a coating agent made of a high-polymer resin for imparting a fixing property to the coloring agent, a dispersant for accelerating the dispersion of toner particles and stabilizing the dispersion, and a charge adjusting agent for controlling the polarity of toner particles and the amount of charges. It should be noted that the toner particles used in this embodiment are charged negative.

A plurality of development rollers 40 corresponding to the image-forming area of the photosensitive material 34A and extending in the axial direction of the photosensitive drum 34 are arranged on the developer unit 36. A portion of the outer peripheral surface of each development roller 40 is immersed in the liquid developer 38. These development rollers 40 are rotated by an unillustrated drive mechanism, and are adapted such that the liquid developer 38 can be applied to the image-forming area via the development rollers 40.

A squeezer 41 having an air jetting portion 41A which extends in the axial direction of the photosensitive drum 34 and opposes the image-forming area is disposed downstream of the developer unit 36 as viewed in the rotating direction of the photosensitive drum 34. An excess portion of the liquid developer 38 supplied to the image-forming area is removed by air from the air jetting portion 41A of the squeezer 41, and is discharged to an unillustrated waste solution tank.

A rinsing solution unit 42 is disposed downstream of the squeezer 41 as viewed in the rotating direction of the photosensitive drum 34. This rinsing solution unit 42 has a box whose upper side is open, and a rinsing solution 44 is accommodated in the box. A plurality of rinsing rollers 46 opposing the image-forming area and extending in the axial direction of the photosensitive drum 34 is disposed in the rinsing solution unit 42. A portion of the outer peripheral surface of each rinsing roller 46 is immersed in the rinsing solution 44. In addition, another portion of each rinsing roller 46 is brought into contact with the photosensitive drum 34 to allow the rinsing solution 44 to be applied to the image-forming area via the rinsing rollers 46.

An exhaust duct 66 constituting a part of a drying section 64 is disposed downstream of the rinsing solution unit 42 as viewed in the rotating direction of the photosensitive drum 34. The side of the exhaust duct 66 which opposes the photosensitive material 34A is formed as an opening portion 66B having substantially the same radius of curvature as that of the photosensitive material 34A. In addition, an air intake chamber 68, which together with the exhaust duct 66 constitutes the drying section 64, is disposed downstream of the exhaust dust 66 as viewed in the rotating direction of the photosensitive drum 34. This air intake chamber 68 is connected to an unillustrated blower and communicates with an air-inlet opening portion 66A located downstream of the exhaust duct 66. The air flow (indicated by arrow U in FIG. 1) sent through the air-inlet opening portion 66A is blown onto the photosensitive material 34A at the opening portion 66B so as to dry the wet photosensitive material 34A. Subsequently, the air is discharged out of the apparatus via an air discharge port 66C.

A corona charging device 70 is disposed downstream of the air intake chamber 68 as viewed in the rotating direction of the photosensitive drum 34. This corona charging device 70 has a corona wire and a grid wire in the same way as the corona charging device 35, and is connected to the DC power source via an unillustrated switch. As a result, the photosensitive drum 34 after the formation of an electrostatic latent image is capable of strengthening the charge of the toner as the charge of the same polarity as that of the toner is applied to the surface of the photosensitive material 34A by the corona charging device 70 (precharging).

A prewetting device 72 is disposed downstream of the corona charging device 70 as viewed in the rotating direction of the photosensitive drum 34. This prewetting device 72 is adapted to apply the carrier solution, i.e., a dispersion medium for the liquid developer for the purpose of improving the transferability of a toner image onto the transfer material.

An intermediate transfer drum 100 is disposed adjacent the prewetting device 72 downstream thereof as viewed in the rotating direction of the photosensitive drum 34.

Figure 2:
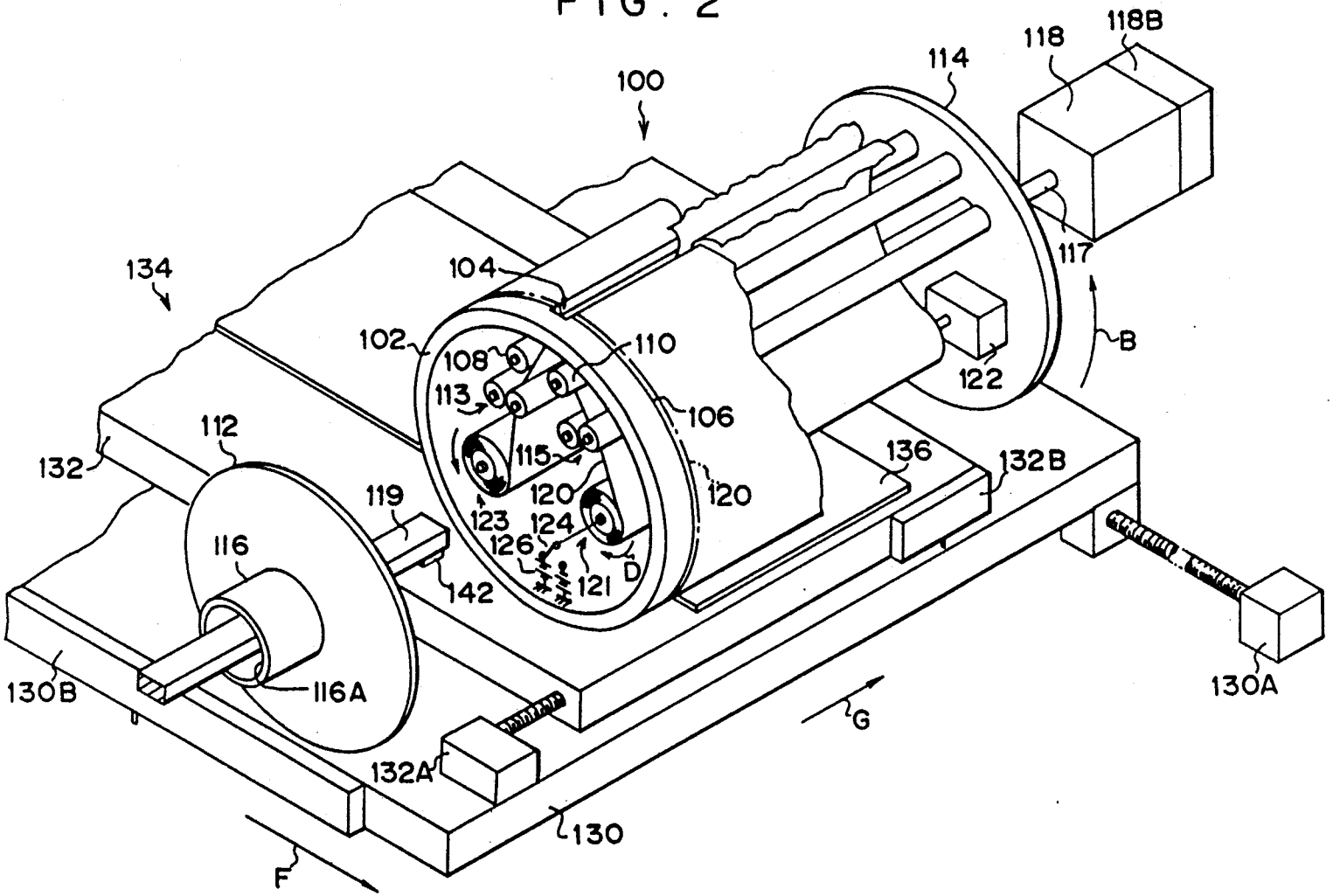
FIG. 2 is a partially cutaway perspective view of an intermediate transfer drum and a machine-plate conveying stage in accordance with the first embodiment.
Figure 3A:
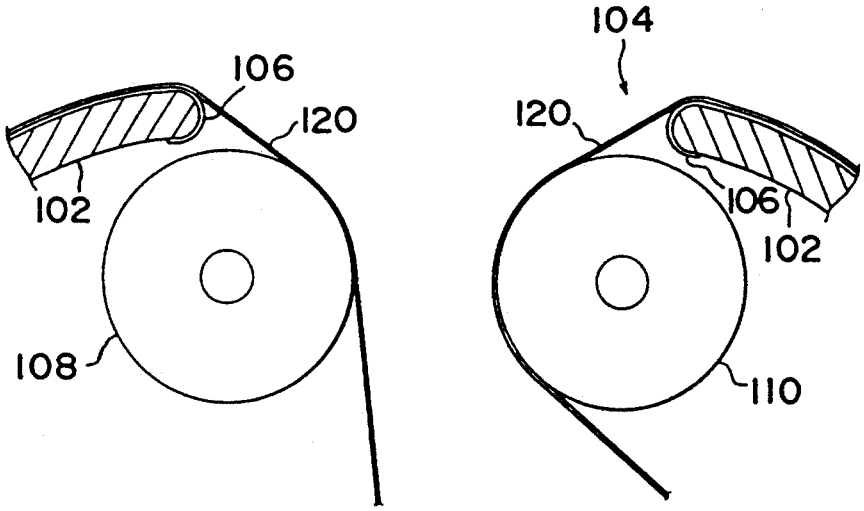
FIG. 3A is a partial cross-sectional view illustrating peripheral components of a slit in a cylindrical portion in accordance with the first embodiment.

As shown in FIG. 2, the intermediate transfer drum 100 constituting the intermediate unit 6 has a hollow cylindrical portion 102 formed of a light-transmitting resin. This cylindrical portion 102 has a slit 104 formed in such a manner as to penetrate in the radial direction thereof and extend along the axis thereof. As shown in FIG. 3A, the outer peripheral surface of the cylindrical portion 102 is covered with a sheet-like resilient member 106 formed of a light-transmitting material. Opposite end portions of the resilient member 106 are secured to the inner peripheral surface of the cylindrical portion 102 in the vicinity of the slit 104 after passing through the slit 104. This resilient member 106 is used to absorb a shock occurring when the photosensitive drum 34 and a machine plate 136 (which will be described later) serving as a recording member are brought into contact with the cylindrical portion 102.

Disk-shaped side walls 112 and 114 are secured to opposite ends of the cylindrical portion 102, respectively. A rotating shaft 116 is formed at a central portion of the outer surface of the side wall 112 in such a manner as to project outwardly. The rotating shaft 116 is rotatably supported on a side plate of an unillustrated apparatus body. The rotating shaft 116 has a through hole 116A (which will be described later) formed in such a manner as to penetrate the rotating shaft 116 along the longitudinal direction thereof Meanwhile, a rotating shaft 117 is secured to a central portion of the outer surface of the side wall 114. This rotating shaft 117 is connected to a motor 118 fixed to the unillustrated apparatus body, and is also connected to a rotary encoder 118B via the motor 118. The rotary encoder 118B converts the rotational position of the intermediate transfer drum 100 to an electrical signal and outputs the same to a control means 98 shown in FIG. 4. The intermediate transfer drum 100 is rotated in the direction of arrow B in FIG. 2 by the motor 118, and its rotational speed is controlled by the control means 98.

Guide rollers 108 and 110 are disposed in the cylindrical portion 102 in the vicinity of the slit 104, opposite ends of the guide rollers 108 and 110 being pivotally supported by the side plates 112 and 114. A pair of support rollers 113 and a pair of support rollers 115 are disposed at positions closer to the axis of the cylindrical portion 102, respective opposite ends thereof being rotatably supported by the side plates 112 and 114. The pair of support rollers 113 are respectively urged in the mutually approaching direction by means of unillustrated urging means, while the pair of support rollers 115 are also respectively urged in the mutually approaching direction by unillustrated urging means. Furthermore, a takeup reel 121 and a supply reel 123 are disposed at positions further closer to the axis of the cylindrical portion 102 from the support rollers 113 and 115.

The opposite ends of the supply reel 123 are supported by the side walls 112, 114, and a film-like intermediate transfer material 120 has been taken up onto the supply reel 123 in the form of a roll. One end of the takeup reel 121 is pivotally supported by the side wall 112, while the other end thereof is connected to a rotating shaft of a motor 122 fixed to an inner side of the side wall 114 and is rotated in the direction of arrow D in FIG. 2. This motor 122 rotates as an unillustrated switch is turned on.

An intermediate portion of the intermediate transfer material 120 is wound around a radially outer peripheral surface of the cylindrical portion 102 via the resilient member 106 after being guided through the pair of support rollers 113, via the support roller 108, and through the slit 104. The tip of the intermediate transfer material 120 is retained by the takeup reel 121 after being guided through the support roller 110 and between the pair of support rollers 115 via the slit 104.

Figure 3B:
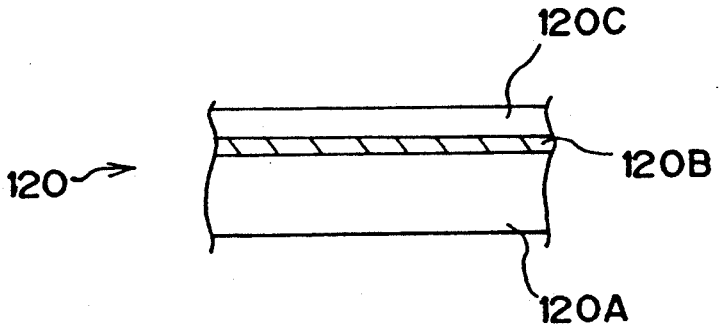
FIG. 3B is a partial cross-sectional view of an intermediate transfer material in accordance with the first embodiment.
Figure 4:
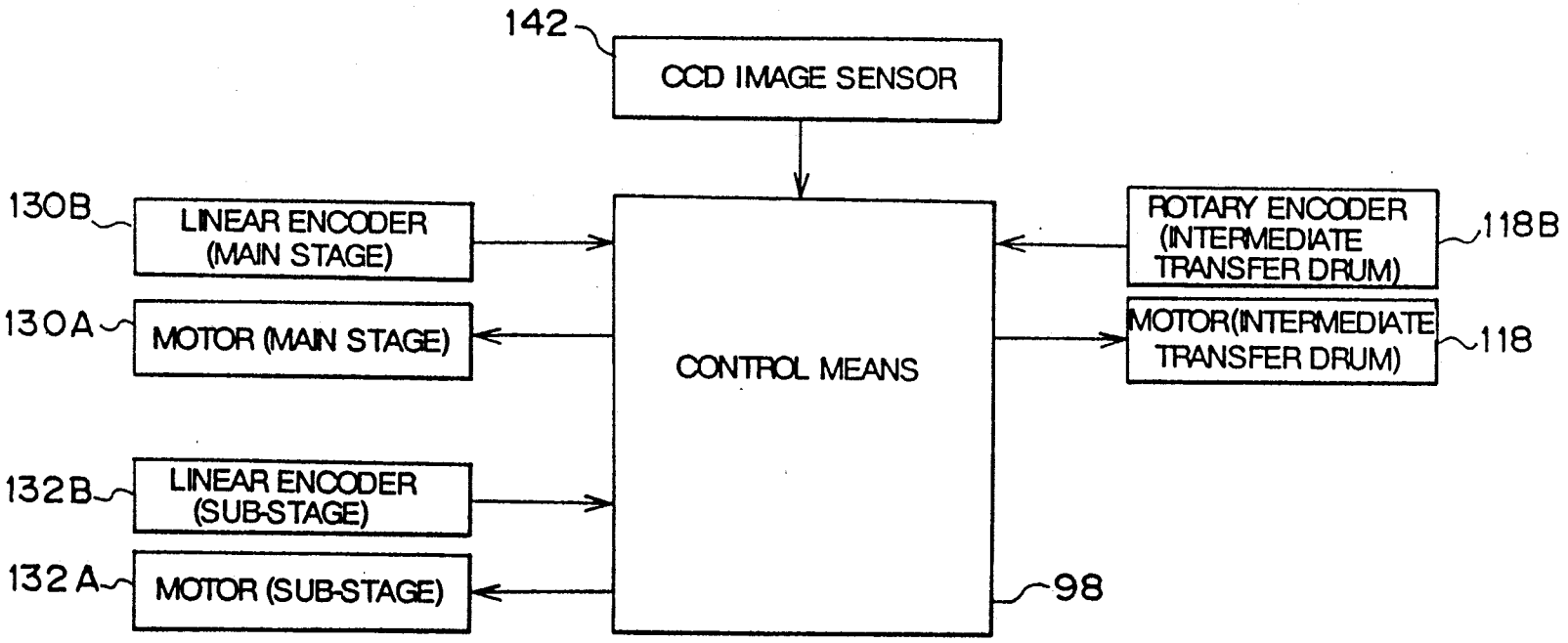
FIG. 4 is a diagram explaining the relationship between a control means and peripheral devices connected to the control means in accordance with the first embodiment.

As shown in FIG. 3B, the intermediate transfer material 120 has a three-layered structure in which a transparent, electrically conductive layer 120B formed of indium oxide is provided on a transparent film-like base 120A formed of polyethylene terephthalate, and a transparent insulating layer 120C formed of polyethylene is further superposed thereon. Accordingly, this intermediate transfer material 120 is arranged to allow light to be transmitted therethrough. As shown in FIGS. 1 and 2, the electrically conductive layer 120B of the intermediate transfer material 120 is connected to a DC bias power source 126 via a polarity changeover switch 124. The DC bias power source 126 is arranged such that the polarity of a voltage applied to the electrically conductive layer 120B changes as the polarity changeover switch 124 is changed over.

Furthermore, as shown in FIG. 2, a CCD image sensor 142 serving as a detecting means is fixedly disposed in the cylindrical portion 102. This CCD image sensor 142 is fixed to an underside of a support member 119 which is inserted into the through hole 116A of the rotating shaft 116, projects into the cylindrical portion 102, and is secured to the unillustrated apparatus body. A detecting surface of the CCD image sensor 142 faces in the radially downward direction of the cylindrical portion 102. Since the cylindrical portion 102, the resilient member 106, and the intermediate transfer material 120 are transparent, the CCD image sensor 142 is capable of detecting an image on the surface of the intermediate transfer material 120 via the cylindrical portion 102, the resilient member 106, and the intermediate transfer material 120. The image detected by the CCD image sensor 142 is converted to electrical signals, and these electrical signals are outputted to the control means 98.

A drying section 52 is disposed downstream, as viewed in the rotating direction of the photosensitive drum 34, of the intermediate transfer drum 100 around the outer periphery of the photosensitive drum 34. This drying section 52 includes an exhaust duct 54, an air-inlet opening portion 54A, an opening portion 54B, an air discharge port 54C, and an air intake chamber 56, and an unillustrated blower, and is arranged in a manner similar to that of the above-described drying section 64. The air (indicated by arrow V in FIG. 1) sent through the air-inlet opening portion 54A is blown onto the photosensitive material 34A at the opening portion 54B so as to dry the wet photosensitive material 34A. Subsequently, the air is discharged out of the apparatus via the air discharge port 54C.

A discharging device 86 is disposed downstream of the drying section 52 as viewed in the rotating direction of the photosensitive drum 34. The discharging device 86 has a corona wire and a grid wire, and is connected to an AC power source via an unillustrated changeover switch. By effecting AC corona discharge with the discharging device 86 connected to the AC power source, the charges on the photosensitive material 34A are neutralized, thereby making it possible to remove the residual potential of the photosensitive material (discharging).

A discharging lamp 88 is disposed downstream of the discharging device 86 as viewed in the rotating direction of the photosensitive drum 34. As the light of this discharge lamp 88 is applied to the photosensitive material 34A, it is possible to neutralize the charges on the photosensitive material 34A (discharging by light). This discharging by light exhibits a function similar to that of discharging by the discharging device 86.

A cleaning section 76 is disposed downstream of the discharge lamp 88 as viewed in the rotating direction of the photosensitive drum 34. The cleaning section 76 is provided with a takeup roller 78 and a web roller 79. A cleaning web 82 formed of a nonwoven fabric or the like is wound around the takeup roller 78 and the web roller 79. The cleaning section 76 further includes a cleaning roller 84 having a plurality of through holes (not shown) formed therein in such a manner as to extend in the axial direction of the photosensitive drum 34. A carrier solution similar to the carrier solution applied by the aforementioned prewetting device 72 is accommodated in the cleaning roller 84. An intermediate portion of the cleaning web 82 is wound around the cleaning roller 84. The cleaning roller 84 opposes the image-forming area via the cleaning web 82, and the cleaning web 82 is in contact with the photosensitive material 34A. In addition, the cleaning web 82 is taken up clockwise by the takeup roller 78. The cleaning roller 84 is rotated clockwise by following the taking-up operation, and the carrier solution flows out of the through holes in conjunction with the rotation thereof. Thus, as the portion of the cleaning web 82 moistened with the carrier solution slides on the surface of the photosensitive material 34A, the residual toner and the like after transfer is removed.

In addition, the photosensitive drum 34 is moved by an unillustrated driving mechanism in a direction in which the photosensitive drum 34 approaches the outer periphery of the intermediate transfer drum 100 (in the direction of arrow C in FIG. 1) and in a direction in which it moves away therefrom (in an opposite direction to the direction of arrow C in FIG. 1).

A drying section 164 is disposed downstream (as viewed in the rotating direction of the intermediate transfer drum 100 as indicated by arrow B in FIG. 1) of an abutting portion 100A of the intermediate transfer drum 100 in abutment with the photosensitive drum 34. This drying section 164 includes an exhaust duct 166, an air-inlet opening portion 166A, an opening portion 166B, an air discharge port 166C, an air intake chamber 168, and an unillustrated blower, and is arranged in a manner similar to that of the above-described drying section 64. However, the opening portion 166B is formed into a circular-arc-shaped configuration having substantially the same radius of curvature as that of the intermediate transfer drum 100. The air (indicated by arrow W in FIG. 1) sent through the air-inlet opening portion 166A is blown onto the intermediate transfer material 120 provided on the intermediate transfer drum 100 at the opening portion 166B. Subsequently, the air is discharged out of the apparatus via the air discharge port 166C.

A cleaning section 176 is disposed in face-to-face relationship with the intermediate transfer material 120 downstream of the drying section 164 as viewed in the rotating direction of the intermediate transfer drum 100. In a manner similar to that of the aforementioned cleaning section 76, this cleaning section 176 has a takeup roller 178, a web roller 179, a cleaning web 182, and a cleaning roller 184. The cleaning section 176 is moved by an unillustrated driving mechanism in a direction in which the cleaning section 176 moves away from the outer peripheral surface of the intermediate transfer material 120 (in the direction arrow E in FIG. 1) and in a direction in which it is brought into contact therewith (in an opposite direction to the direction of arrow E in FIG. 1).

A corona charging device 186 is disposed downstream of the cleaning section 176 as viewed in the rotating direction of the intermediate transfer drum 100. In a manner similar to that of the aforementioned corona charging device 35, this corona charging device 186 has a corona wire and a grid wire, and is connected to a DC power source via an unillustrated switch.

A prewetting device 188 is disposed downstream of the corona charging device 186 as viewed in the rotating direction of the intermediate transfer drum 100. This prewetting device 188 applies the carrier solution, i.e., a dispersion medium for the liquid developer, to the intermediate transfer material 120 for the purpose of improvising the transferability of the toner image onto the intermediate transfer material 120.

As shown in FIG. 2, the machine-plate conveying stage 134 comprising at hick, tabular main stage 130 and a .thick, tabular sub-stage 132 is disposed below the intermediate transfer drum 100 downstream of the prewetting device 188 as viewed in the rotating direction of the intermediate transfer drum 100. The main stage 130 is capable of moving in the tangential direction of the intermediate transfer drum 100 (in the direction of arrow F and in an opposite direction thereto) along an unillustrated guide mechanism. In addition, the main stage 130 is reciprocatively moved in the direction of arrow F and in an opposite direction thereto as a motor 130A controlled by the control means 98 is rotated. Furthermore, a linear encoder 130B for detecting the position of the main stage 130 in the moving direction thereof is attached to a side surface of the main stage 130 along the moving direction thereof. This linear encoder 130B converts the position of the main stage 130 to an electrical signal and outputs the electrical signal to the control means 98.

The sub-stage 132 is guided on the main stage 130 by an unillustrated guide mechanism in such a manner as to be movable in the direction of arrow G and in an opposite direction thereto along the axis of the intermediate transfer drum 100. The sub-stage 132 is reciprocatively moved in the direction of arrow G and in an opposite direction thereto as a motor 132A controlled by the control means 98 rotates. In addition, a linear encoder 132B for detecting the position of the sub-stage 132 in the moving direction thereof is attached to a side surface of the sub-stage 132 along the moving direction thereof (in the direction of arrow G and in an opposite direction thereto). This linear encoder 132B converts the position of the sub-stage 132 to an electrical signal and outputs the electrical signal to the control means 98.

A rectangular machine plate 136 formed of a flat aluminum plate is placed on an upper surface of the sub-stage 132. This machine plate 136 is detachably fixed on the sub-stage 132 at a predetermined position thereof by means of an unillustrated positioning/fixing device.

As shown in FIG. 1, an exhaust duct 156 constituting a part of a drying section 154 is disposed forwardly of the machine plate 136 on the machine-plate conveying stage 134 in the advancing direction of the machine plate 136 (as viewed in the direction of arrow F in FIG. 1). The side of this exhaust duct 156 opposing the machine plate 136 on the machine-plate conveying stage 134 is formed as an opening portion 156B, while the side of the exhaust duct 156 away from the machine plate 136 is formed as an ar discharge port 156C. In addition, an intake chamber 158 constituting the drying section 154 together with the exhaust duct 156 is disposed adjacent the exhaust duct 156 in the direction of arrow F in FIG. 1. The side of the intake chamber 158 away from the machine plate 136 side thereof is connected to an unillustrated blower, while the machine plate 136 side thereof opposes an air-inlet opening portion 156A located on a side of the exhaust duct 156 facing the direction of arrow F in FIG. 1. The air flow (indicated by arrow X in FIG. 1) sent through the air-inlet opening portion 156A is blown onto the surface of the machine plate 136 provided on the sub-stage 132, and passes through the opening portion 156B before it is discharged out of the apparatus via the air discharge port 156C.

The operation of this embodiment will be described hereinunder.

A description will be given of a process for making a machine plate 136 for a first color used in multicolor printing. First, the machine plate 136 for the first color is fixed at a predetermined position on the sub-stage 132 by means of an unillustrated fixing device. Then, as an unillustrated start switch is turned on, or by means of a start signal from the outside, the photosensitive unit 4 is moved by an unillustrated drive mechanism in a direction in which it approaches the intermediate transfer drum 100 (in the direction of arrow C in FIG. 1), with the result that the intermediate transfer material 120 set on the intermediate transfer drum 100 is clamped by the intermediate transfer drum 100 and the photosensitive material 34A.

Figure 5:
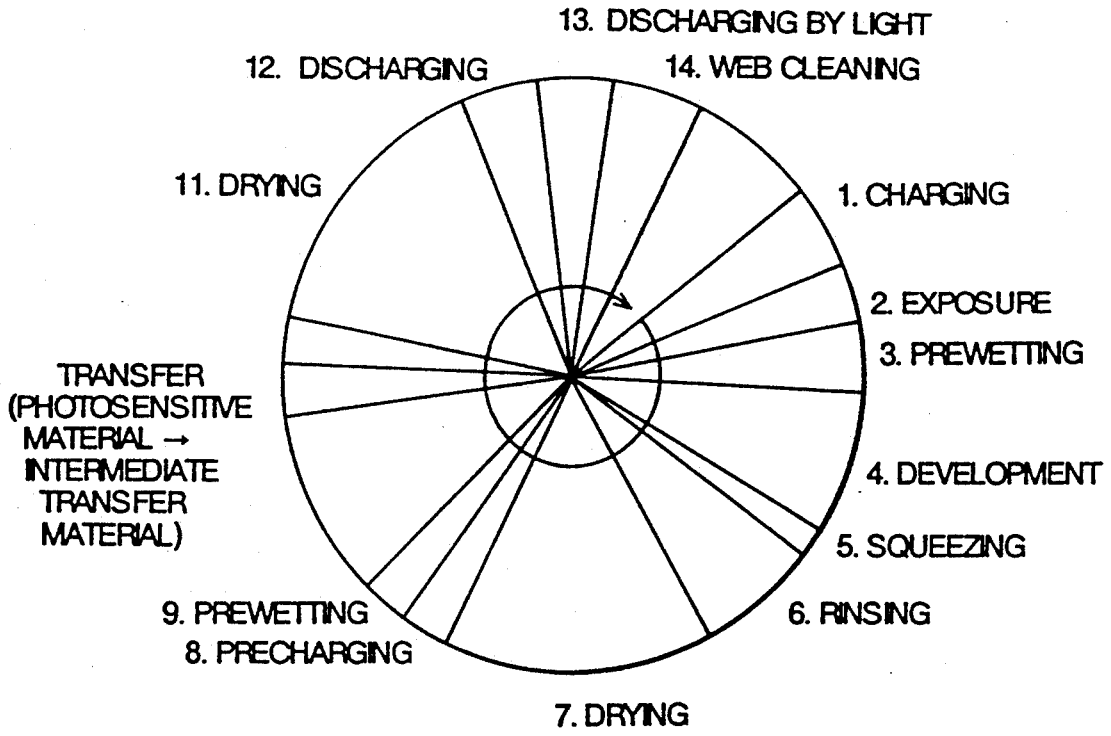
FIG. 5 is a diagram illustrating the processing steps of a photosensitive material in accordance with the first embodiment.

Then, the photosensitive drum 34 is rotated in the direction of arrow A in FIG. 1 by an unillustrated driving means, and the corona charging device 35 is operated to charge the surface of the air-inlet opening portion 156A is blown onto the positive by means of DC corona charging (charging in FIG. 5).

Figure 10:
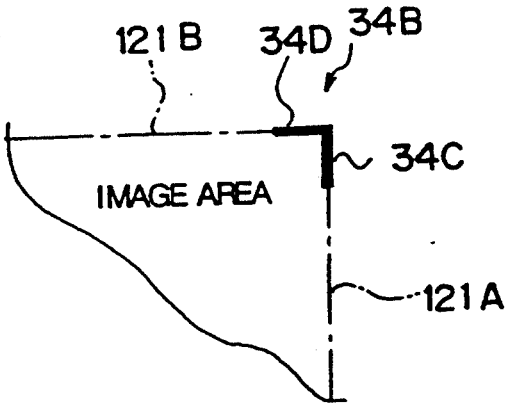
FIG. 10 is a diagram explaining the positional relationship between an image area recorded on the photosensitive material and the mark in accordance with the first embodiment.

When an image-forming portion of the photosensitive material 34A whose surface is uniformly charged positive reaches an exposing position, a laser beam applied from the semiconductor laser 12 is modulated in correspondence with the image information supplied by the host computer 22, thereby allowing the photosensitive material 34 to be exposed imagewise (exposure in FIG. 5). At this time, as shown in FIG. 10, a mark 34B which indicates both an image-area front end 121A and an image-area side end 121B is exposed together with an image. The mark 34B is formed at a corner portion where the image-area front end 121A and the image-area side end 121B abut each other. This mark 34B is formed in an L-shape comprising a line 34C formed on the image-area front end 121A and a line 34D formed on the image-area side end 121B.

When the surface of the photosensitive material 34A is imagewise exposed, the portion to which the laser beam has been applied becomes electrically conductive, so that the positive charges on the surface move thereto, thereby forming an electrostatic latent image corresponding to the image information.

The photosensitive 34A on the surface of which the electrostatic latent image has been formed further rotates in the direction of arrow A in FIG. 1, and the carrier solution is applied uniformly to the surface of the photosensitive material 34A by the prewetting device 50 (prewetting in FIG. 5).

The prewetted portion of the photosensitive material 34A further rotates in the direction of arrow A in FIG. 1, and reaches a position corresponding to the developer unit 36. The liquid developer containing toner particles is applied via the development rollers 40 to the area where the electrostatic latent image has been formed, by means of the developer unit 36. As a result, the negatively charged toner particles in the developer adhere to an image portion where the electrostatic latent image is formed, causing the electrostatic latent image to become visible and forming a toner image corresponding to an image portion or a non-image portion (development in FIG. 5).

The photosensitive material 34A further rotates in the direction of arrow A in FIG. 1, and the surface portion where the toner image has been formed reaches a position corresponding to the squeezer 41. Air jetted from the air-jetting portion 41A is blown onto the portion where the toner image has been formed, and that portion is thereby squeezed. As a result, an excess portion of liquid developer 38 is removed from the surface of the photosensitive 34A and is led to an unillustrated tank (squeezing in FIG. 5).

The photosensitive material 34 further rotates in the direction of arrow A in FIG. 1, and the portion where the toner image has been formed reaches a position corresponding to the rinsing solution unit 42 filled with the rinsing solution 44. The rinsing solution 44 is supplied to the surface of the photosensitive material 34A via the rinsing rollers 46, so that an unnecessary portion of the developer including toner particles which adheres to the portion of the photosensitive material 34 other than the image portion where the toner should adhere is rinsed off (rinsing in FIG. 5).

The photosensitive material 34A further rotates in the direction of arrow A in FIG. 1, and opposes the drying section 64. Dry air supplied from an unillustrated blower is jetted from the air-inlet opening portion 66A to the surface of the photosensitive material 34A so as to dry the surface of the photosensitive material 34A. By virtue of this drying, the rinsing solution and the carrier solution which are present between the toner particles forming the electrostatic latent image evaporate, and an interaction (bonding force) between the toner particles is enhanced (drying in FIG. 5).

The photosensitive material **34*a* is further rotated, and charges of the same polarity as that of the toner are applied to the photosensitive material 34A by DC corona charging using the corona charging device 70, thereby strengthening the charges of the toner (precharging in FIG. 5**).

In this state, the photosensitive material 34A is further rotated in the direction of arrow A in FIG. 1, and the carrier solution is applied uniformly to the surface of the photosensitive material 34A by the prewetting device 72. As a result, it becomes possible for the toner image to be readily transferred onto the intermediate transfer material 120 (prewetting in FIG. 5).

If the photosensitive material 34A is further rotated, the intermediate transfer material 120 wound around the outer peripheral surface of the intermediate transfer drum 100 is brought into contact with the photosensitive material 34A, thereby allowing the toner image on the photosensitive material 34A to be transferred onto the intermediate transfer material 120. Here, the intermediate transfer material 120 is clamped softly by the photosensitive material 34*a* and the resilient member 106 disposed on the outer peripheral surface of the intermediate transfer drum 100. Accordingly, the intermediate transfer material 120 is not subjected to an impact at the time when it is brought into contact with the photosensitive material 34A, so that damage is unlikely to occur to the surface portion of the intermediate transfer material 120, and the intermediate transfer material 120 can be used over extended periods of time.

In addition, when the image is transferred from the photosensitive material 34*a* to the intermediate transfer material 120, the voltage supplied from the DC bias power source to the electrically conductive layer 120B of the intermediate transfer material 120 is set to positive. As a result, the negatively charged toner image is drawn toward the intermediate transfer material 120, and can be easily transferred onto the intermediate transfer material 120.

The intermediate transfer material 120 to which the toner image has been transferred is rotated together with the intermediate transfer drum 100 in the direction of arrow B in FIG. 1, and faces the drying section 164. Dry air supplied from an unillustrated blower is jetted to the surface of the intermediate transfer material 120 through the air-inlet opening portion 166A. The wet intermediate transfer material 120 and the toner image are dried by this dry air (drying in FIG. 6(A)). The bonding force between the toner particles is enhanced by this drying.

Figure 6A:
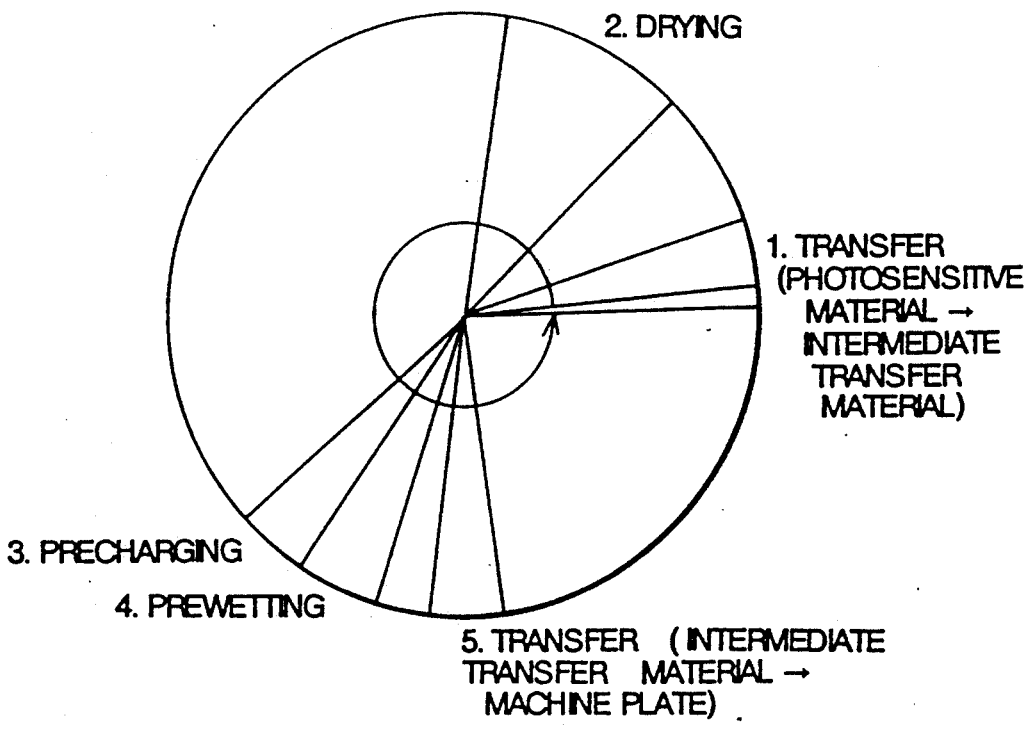
FIGS. 6 A and 6 B are diagrams illustrating the processing steps of the intermediate transfer material in accordance with the first embodiment.

The intermediate transfer drum 100 is further rotated, and charges of the same polarity as that of the toner image are applied to the toner image by means of DC corona charging using the corona charging device 186, thereby making it possible to strengthen the charges of the toner (precharging in FIG. 6(A)).

In this state, the intermediate transfer drum 100 is further rotated in the direction of arrow B in FIG. 1, and the carrier solution is applied uniformly to the surface of the intermediate transfer material 120 by the prewetting device 188. As a result, it becomes possible for the toner image to be readily transferred onto the machine plate 136 (prewetting in FIG. 6(A)).

After the image in the photosensitive unit 4 has been transferred to the intermediate transfer material 120, the photosensitive unit 4 is moved in an opposite direction to the direction of arrow C in FIG. 1 by means of the unillustrated drive mechanism, thereby causing the photosensitive drum 34 to be spaced apart from the intermediate transfer material 120. Subsequently, the polarity changeover switch 124 is operated so as to set the voltage supplied from the DC bias power source to the electrically conductive layer 120B of the intermediate transfer material 120 to the negative polarity. As a result, the negatively charged toner image receives a reactionary force from the intermediate transfer material 120 and becomes easy to be transferred onto the machine plate 136.

Figure 9A:
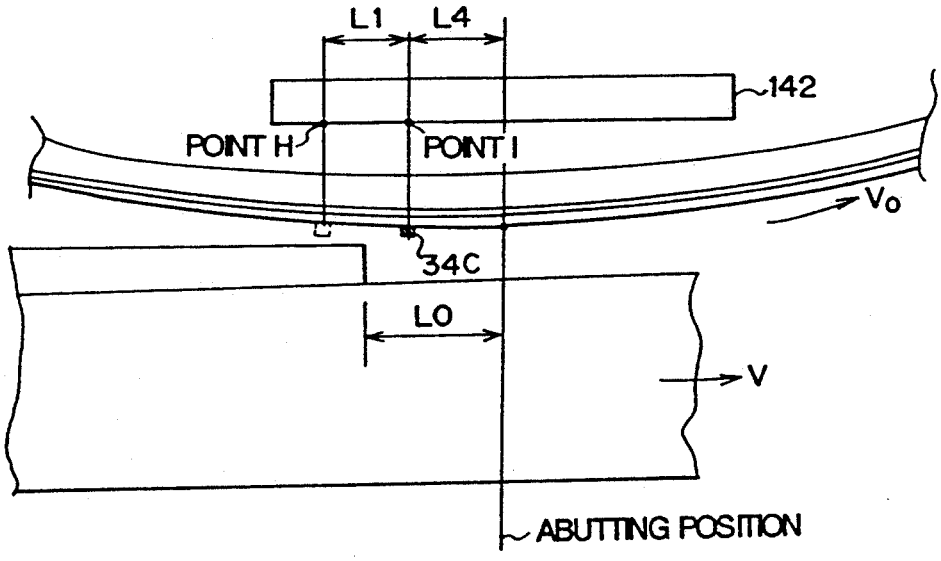
FIGS. 9 A and 9 B are diagrams illustrating a mark on the intermediate transfer material, a forward end of a machine plate, and portions in the vicinity of a position of abutment between the intermediate transfer material and the machine plate in accordance with the first embodiment.
Figure 9B:
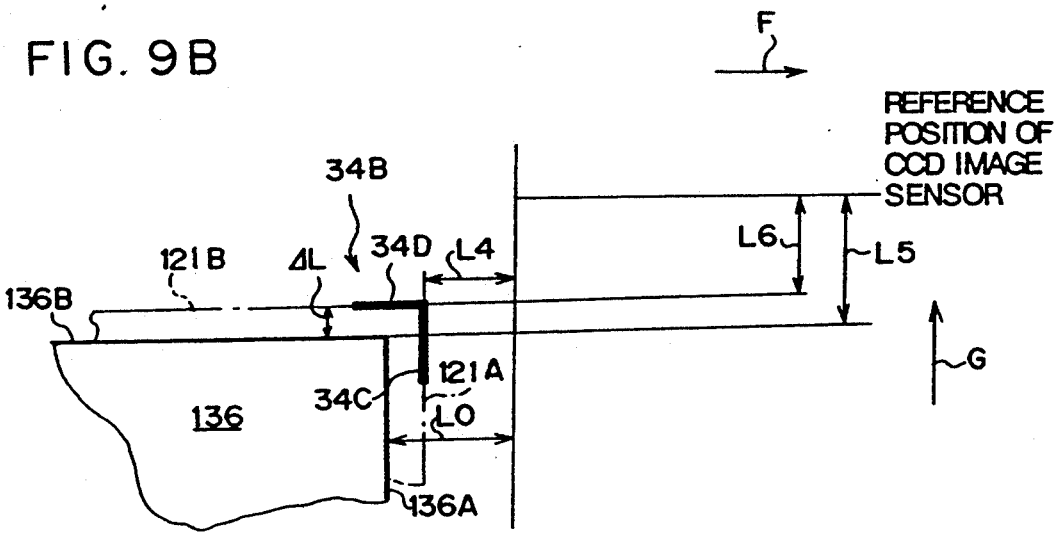

When the intermediate transfer material 120 is further rotated in the direction of arrow B in FIG. 1, the mark 34B formed on the intermediate transfer material 120 is detected by the CCD image sensor 142 (see FIGS. 9(A) and 9(B)). In this state, the machine-plate conveying stage 134 has been moved such that a forward end portion 136A of the machine plate 136 reaches a position immediately before the position of contact between the intermediate transfer material 120 and the machine plate 136. As a result, the CCD image sensor 142 detects the corner portion at a forward end of the machine plate 136 in the advancing direction thereof (in the direction of arrow F in FIGS. 9(A) and 9(B)) at the same time as it detects the mark 34B formed on the intermediate transfer material 120. At this juncture, the control means 98 causes the image-area front end 121A and the front end 136A of the machine plate 136 to be registered with each other, and controls the moving velocity of the main stage 130 such that the intermediate transfer material 120 and the machine plate 136 are moved at the same velocity after they are brought into contact with each other. Furthermore, the control means 98 controls the movement of the sub-stage 132 such that the image-area side end 121B will be registered with a side end 136B of the machine plate 136.

Control at the time when the toner image on the intermediate transfer material 120 is transferred onto the machine plate 136 will be described in accordance with flowcharts shown in FIGS. 7(A), 7(B), 7(C), 7(D), and 8, as well as FIGS. 9(A) and 9(B).

Figure 8:
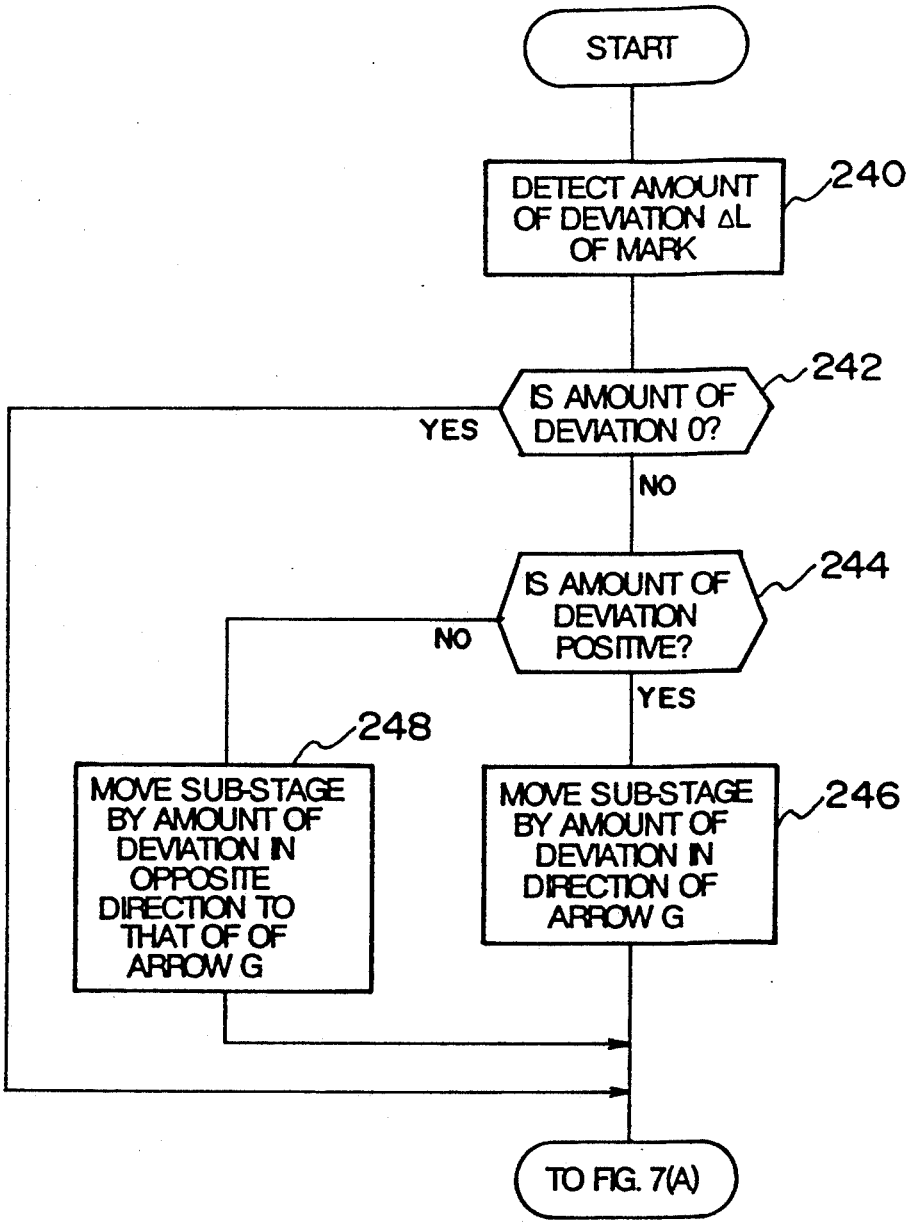
FIG. 8 is a flowchart illustrating the operation of the first embodiment.

First, a description will be given of control for registering the image-area side end 121B with the side end 136B of the machine plate 136. As shown in FIG. 8, in Step 240, an amount of deviation ΔL between the image-area side end 121B and the side end 136B of the machine plate 136 is calculated on the basis of a dimension L6 from the reference position of the CCD image sensor 142 to the line 34D and a dimension L5 from the reference position of the CCD image sensor 142 to the side line 136B of the machine plate 136 in accordance with the following formula:

$$\Delta L = L5 - L6$$

In Step 242, a determination is made as to whether or not the amount of deviation ΔL is 0. If the amount of deviation ΔL is 0, the operation proceeds to routine work shown in FIG. 7(A), and if the amount of deviation ΔL is other than 0, the operation proceeds to Step 244. In this Step 244, a determination is made as to whether the amount of deviation ΔL is positive or negative. If the amount of deviation ΔL is positive, the sub-stage 132 is moved by ΔL in the direction of arrow G in Step 246. If the amount of deviation ΔL is negative, the sub-stage 132 is moved by ΔL in the opposite direction to the direction of arrow G in Step 248. As a result, the image-area side end 121B and the side end 136B of the machine plate 136 are registered with each other, so that the transverse deviation of the machine plate 136 (in the direction of arrow G and in the opposite direction thereto) is eliminated.

Figure 7A:
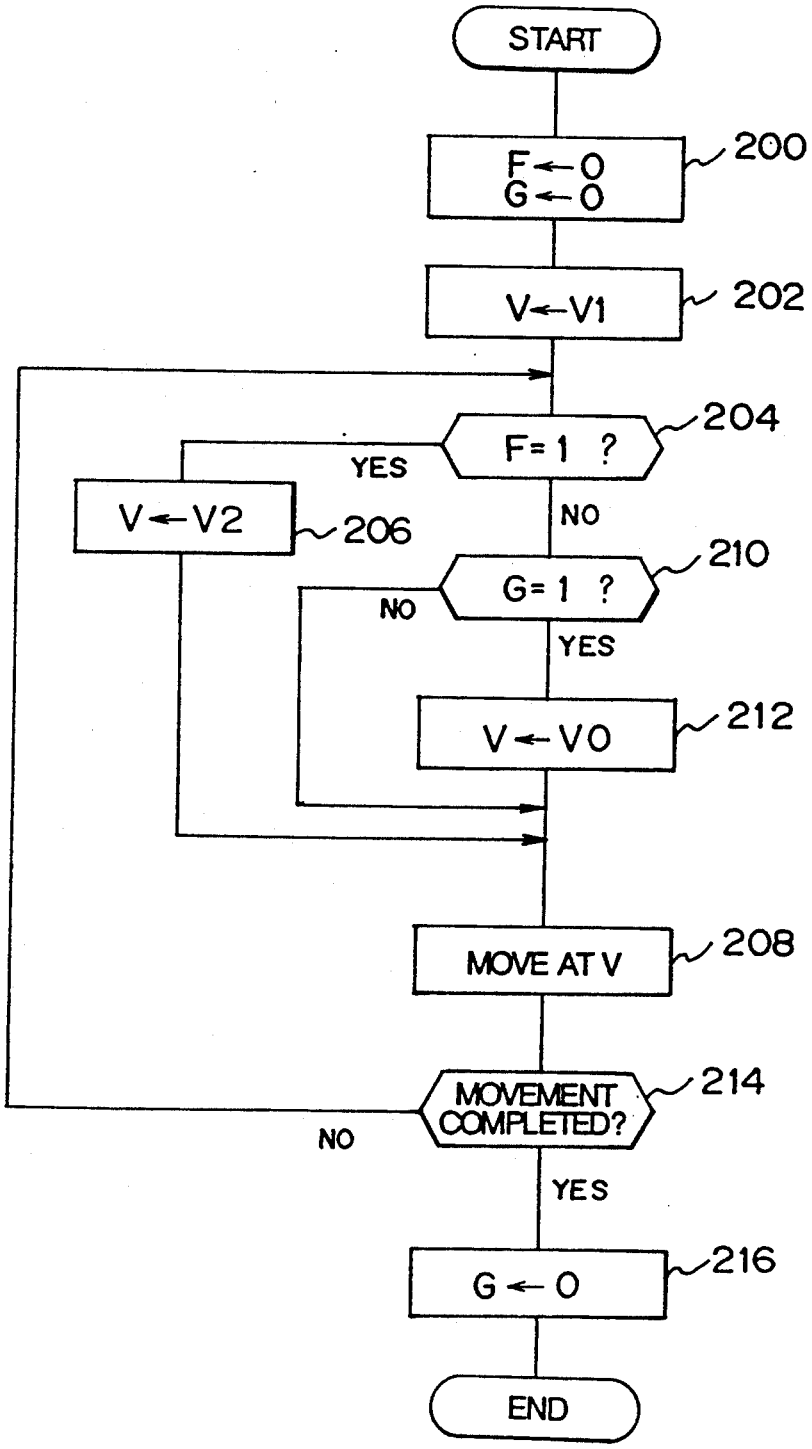
FIGS. 7 A to 7 D are flowcharts illustrating the operation of the first embodiment.

Next, a description will be given of control for registering the image-area front end 121A of the intermediate transfer material 120 and the front end 136A of the machine plate 136 with each other. As shown in FIG. 7(A), a flag F and a flag G are reset in Step 200, and the operation proceeds to Step 202. In Step 202, the velocity V of the main stage 130 is set to a velocity V1. This velocity V1 is a velocity set in advance, and is identical with the moving velocity of the intermediate transfer material 120 determined by an angular velocity of the intermediate transfer drum 100 and a distance from the axis of the intermediate transfer drum 100 to the surface of the intermediate transfer material 120.

In Step 204, a determination is made as to whether or not the flag F which is set when the CCD image sensor 142 has detected the line 34C is 1. If it is determined in Step 204 that the flag F is set to 1, the operation proceeds to Step 206 to set the velocity V of the main stage 130 to a velocity V2 calculated by a method which will be described later, and the operation then proceeds to Step 208 to move the main stage 130 at the velocity V2. If it is determined in Step 204 that the flag f is reset, the operation proceeds to Step 210 to determine whether or not the flag G is set to 1. If it is determined in Step 210 that the flag G is set to 1, the operation proceeds to Step 212 to change the velocity V of the main stage 130 to a velocity V0 calculated by a method which will be described later, and the operation proceeds to Step 208 to move the main stage 130 at the velocity V1 set in Step 202 or the velocity V2 set in Step 206. Subsequently, the operation proceeds to Step 214 to determine whether or not the movement of the main stage 130 has been completed. It it is determined that the movement of the main stage 130 has been completed, the operation proceeds to Step 216 to reset the flag G, thereby completing the transfer process for the machine plate 136. If it is determined in Step 214 that the movement of the main stage 130 has not been completed, the operation returns to Step 204.

Figure 7B:
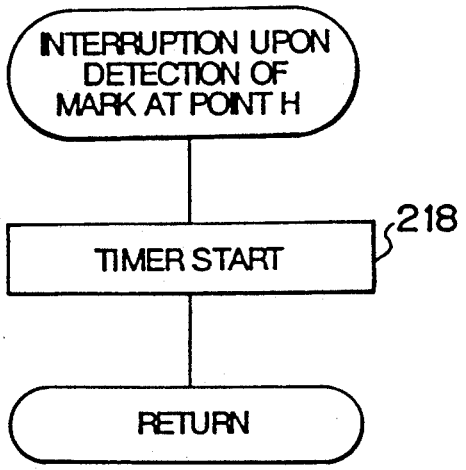

When the CCD image sensor 142 detects the line 34C at a predetermined point H (shown in FIG. 9(A)), an interrupt routine upon detection of a mark at a point H, shown in FIG. 7(B), is started. In Step 218, a timer is started, and the operation returns to the main routine shown in FIG. 7(A). When the CCD image sensor 142 detects the line 34C at a point I (shown in FIG. 9(A)) spaced apart a predetermined dimension L1 from the point H in the advancing direction of the machine plate 136 (in the direction of arrow F in FIGS. 9(A) and 9(B)), an interrupt routine upon detection of a mark at a point I, shown in FIG. 7(D), is started. In Step 222, the timer started in Step 218 of FIG. 7(B) is stopped, and the operation proceeds to Step 224 to calculate a time T during which the line 34C moved from the point H to the point I.

Then, the operation proceeds to Step 226 where the control means 98 calculates the moving velocity V0 of the line 34C (the moving velocity of the intermediate transfer material 120) in accordance with the following formula:

$$VO=L1/T$$

The operation then proceeds to Step 228 where the control means 98 calculates the moving velocity V2 of the main stage 130 for causing the front end 136A of the machine plate 136 and the image-area front end 121A of the intermediate transfer material 120 to be registered with each other at the abutting position shown in FIG. 9(A) in accordance with the following formula:

$$V2=VO\times 10/L4$$

The operation then proceeds to Step 230 to set the flag F to 1. In Step 232, the control means 98 calculates a timing T1 at which the image-area front end 121A and the front end portion of the machine plate 136 are brought into contact with each other, in accordance with the following formula:

$$T1=LO/V2$$

Figure 7C:
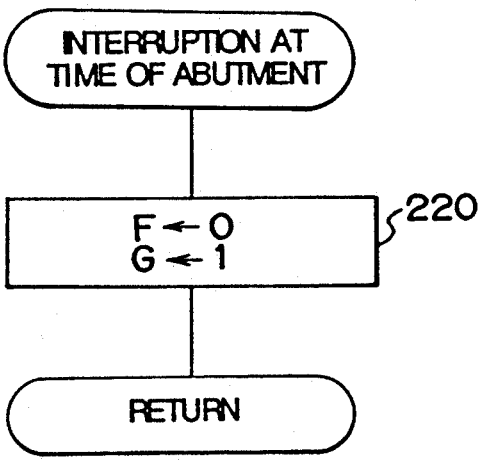
Figure 7D:
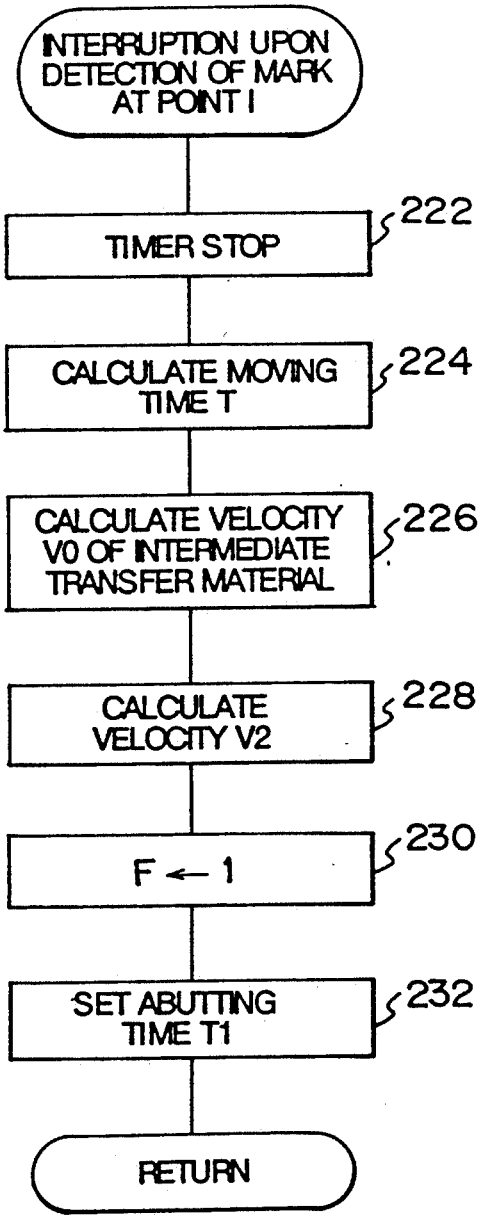

Upon arrival of the time T1 when the image-area front end 121A and the front end 136A of the machine plate 136 are brought into contact with each other, an interrupt routine at the time of abutment, shown in FIG. 7(C), is started, and in Step 220, the flag F is set to 0 and the flag G is set to 1. as a result, the velocity V of the main stage 130 is set to the moving velocity of the line 34C, i.e., to the moving velocity V0 of the intermediate transfer material 120. Accordingly, the main stage 130 is moved at the same velocity as the moving velocity V0 of the intermediate transfer material 120, and the image on the intermediate transfer material 120 is transferred onto the machine plate 136 without being offset therefrom.

Figure 6B:
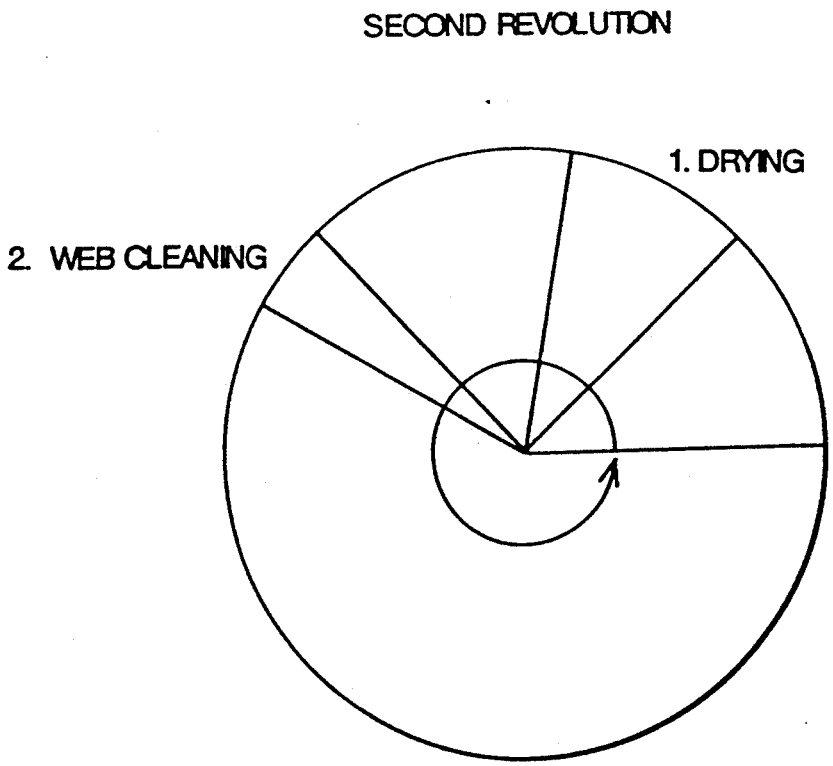

Upon transfer onto the machine plate 136, the intermediate transfer material 120 is further rotated together with the intermediate transfer drum 100 in the direction of arrow B in FIG. 1 to effect a second revolution, and the intermediate transfer material 120 faces the drying section 164. Dry air supplied from the unillustrated blower is jetted to the surface of the intermediate transfer material 120 through the air-line opening portion 166A. The surface of the intermediate transfer material 120 wetted by the prewetting device 188 is dried by this dry air (drying in FIG. 6(B)).

The intermediate transfer material 120 whose surface has been dried is further rotated in the direction of arrow B, and the operation proceeds to a cleaning process. In this cleaning process, web cleaning is carried out to remove the residual toner and the like after transfer (web cleaning in FIG. 6(B)).

Meanwhile, the photosensitive material 34A rotates in the direction of arrow A in FIG. 1, and the portion thereof for which transfer to the intermediate transfer material 100 has been completed faces the drying section 52. Dry air supplied from the unillustrated blower is jetted to the surface of the photosensitive material 34A through the air-inlet opening portion 54A. The surface of the photosensitive material 34A wetted by the prewetting device 72 is dried by this dry air (drying in FIG. 5).

The photosensitive material 34A further rotates in the direction of arrow A in FIG. 1, and the portion of the photosensitive material 34A facing the discharging device 86 is subjected to discharging by AC corona discharging using the discharging device 86 (discharging in FIG. 5). Then, the photosensitive material 34A further orates in the direction of arrow A in FIG. 1, and light emitting from the discharge lamp 88 is supplied to the portion discharged by the discharging device 86, with the result that the charges remaining in the photosensitive material 34A after discharging are removed (discharging by light in FIG. 5. The photosensitive 34A further rotates in the direction of arrow A in FIG. 1, and the portion of photosensitive material 34A with charges removed therefrom proceed to a cleaning process. In this cleaning process, web cleaning is carried out to remove the residual toner and the like after transfer (web cleaning in FIG. 5).

This completes the making of the machine plate 136 for the first color.

Then, a description will be given of a case where the machine plate 136 for a second color is made. First, the machine plate 136 fixed at the predetermined position on the sub-stage 132 is replaced with the machine plate 136 for the second color. Subsequently, in the same way as the making of the machine plate 136 for the first color, as the unillustrated start switch is turned on, or by means of a start signal from the outside, the electrophotographic plate-making apparatus 2 starts processing.

The portion of the photosensitive material 34A for which the above-described process for the first color has been completed and from which foreign objects have been removed is sequentially charged in conjunction with the rotation of the photosensitive drum 34 in the same way as the image-forming process for the first color (charging in FIG. 5). Then, Image information on the image for the second color to be transferred is supplied by the host compute 22, and exposure is effected in a manner similar to that described above (exposure in FIG. 5), thereby allowing an electrostatic latent image to be formed on the photosensitive material 34A. Thereafter, processing is effected in the same way as described above, whereby the image for the second color is transferred from the photosensitive material 34A onto the intermediate transfer material 120, and the image for the second color is transferred from the intermediate transfer material 120 to the machine plate 136.

At the time when the image for the second color is transferred onto the machine plate 136, control is effected in the same way as the above-described case in which the image for the first color was transferred onto the machine plate 136, and the image on the intermediate transfer machine 120 is transferred onto the machine plate 136 without being offset. Thus, in the case of transferring the image on the intermediate transfer material 120 onto the machine plate 136 as dwell, before the image on the intermediate transfer material 120 is brought into contact with the machine plate 136, the image-area side end 121B and the side end 136B of the machine plate 136 are registered with each other, the image-area front end 121A and the front end 136A of the machine plate 136 are registered with each other, and the main stage is moved in conformity with the velocity of the intermediate transfer material 120. Hence, the image on the intermediate transfer material 120 is always formed at a predetermined position on the machine plate 136. Accordingly, even in cases where the machine plates 136 for the second, third, and subsequent colors are made, the above-described control is effected, so that image formed on the respective machine plate is always transferred to the predetermined position on the machine plate without being offset. Since the positional accuracy of the image is excellent, color offset does not occur when printing is conducted by using the machine plates 136 thus made.

In addition, in a case where the surface of the intermediate transfer material 120 is deteriorated due to use over long periods of time, as the motor 122 provided in the intermediate transfer drum 100 is rotated in the direction of arrow D in FIG. 1 by turning on the unillustrated switch, the deteriorated portion of the intermediate transfer material 120 disposed around the outer peripheral surface of the intermediate transfer drum 100 is taken up onto the takeup reel 121, and a new portion of the intermediate transfer material 120 is paid out of the supply reel 123, thereby making it possible to place the new portion of the intermediate transfer material 120 around the outer peripheral surface of the intermediate transfer drum 100. Accordingly, the replacement of the deteriorated portion of the intermediate transfer material 120 can be conducted speedily and readily.

Figure 11:
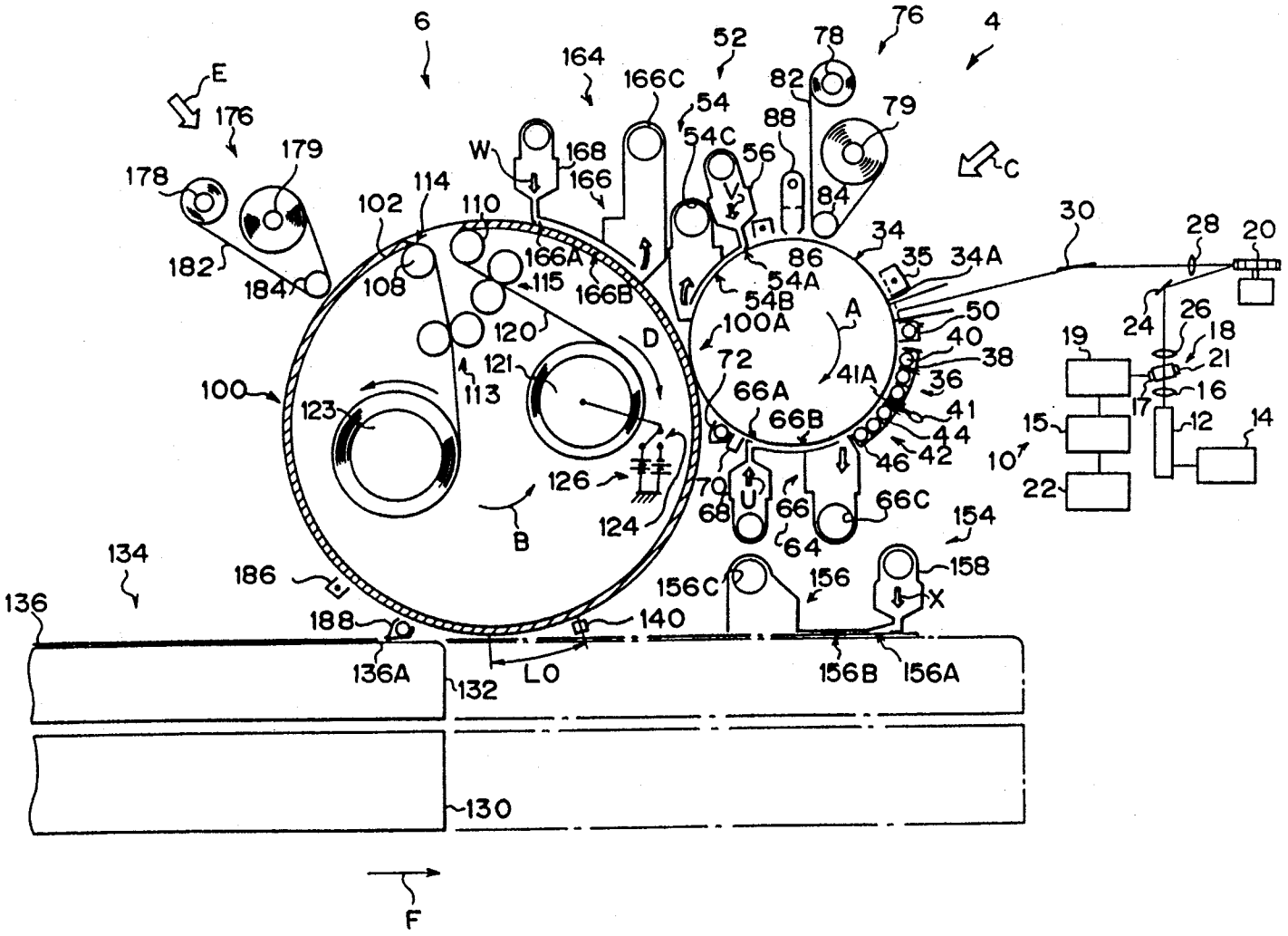
FIG. 11 :s a schematic diagram illustrating the layout of various processing portions and a photosensor which constitute an electrophotographic plate-making apparatus in accordance with a second embodiment.
Figure 12:
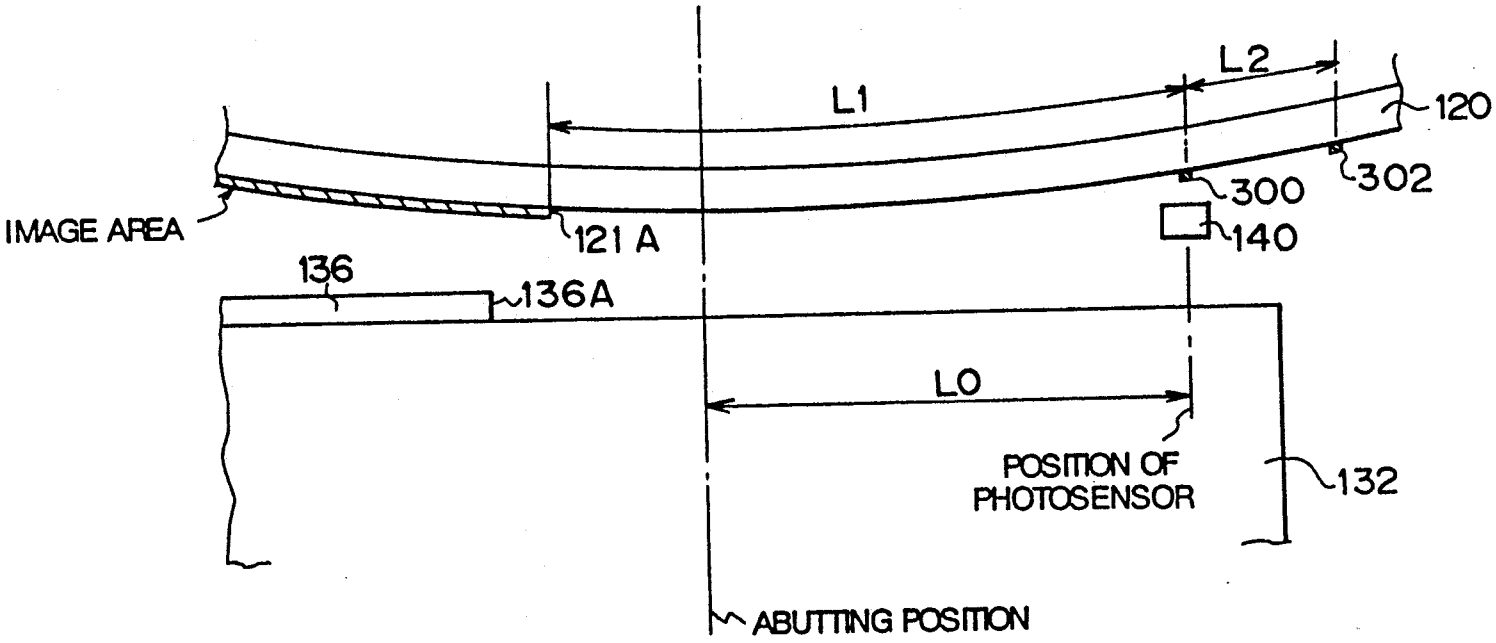
FIG. 12 is a diagram illustrating the positional relationship among the photosensor, the intermediate transfer material, and marks in accordance with the second embodiment.

Referring now to FIGS. 11 and 12, a description will be given of a second embodiment of the present invention. It should be noted that the same component parts, members, and the like as those of the first embodiment will be denoted by the same reference numerals, and a description thereof will be omitted.

In the second embodiment, unlike the first embodiment, a photosensor 140 serving as a detecting means is disposed below the intermediate transfer drum 100 downstream, as viewed in the rotating direction of the drum 100, of the abutting portion of the drum 100 for abutment with the sub-stage 132 in such a manner as to be spaced apart by the dimension L0 from the position of abutment between the intermediate transfer material 120 and the machine plate 136. In addition, as shown in FIG. 12, a plurality of marks indicating the position of the image-area front end 121A are formed in advance on the intermediate transfer material 120. Specifically, a mark 300 which precedes the image-area front end 121A by the dimension L1 in the advancing direction, as well as a mark 302 which precedes the mark 300 by the dimension L2, are formed in advance on the intermediate transfer material 120.

The photosensor 140 first detects the mark 302 which has moved first, and then detects the mark 300. The control means 98 calculates the moving velocity of the intermediate transfer material 120 on the basis of the timing when the mark 302 was detected, the timing when the mark 300 was detected, and the dimension L2, and calculates the time duration during which the image-area front end 121A reaches the position of abutment between the intermediate transfer material 120 and the machine plate 136. The control means 98 calculates the moving velocity of the main stage 130 and controls the motor 130A of the main stage 130 in such a manner that the front end 136A of the machine plate 136 will register with the image-area front end 121A at the timing when the image-area front end 121A of the intermediate transfer material 120 reaches the position of abutment between the intermediate transfer material 120 and the machine plate 136. After the front end 136A of the machine plate 136 and the image-area front end 121A of the intermediate transfer material 120 are registered with each other, the control means 98 controls the motor 130A in such a manner that the main stage 130 is moved at the moving velocity of the intermediate transfer material 120. Thus, by providing the intermediate transfer material 120 with the plurality of marks indicating the image area, and by detecting these marks, it is possible to detect the moving velocity of the intermediate transfer material 120 and the position of the image area of the intermediate transfer material 120. Consequently, the control means 98 is capable of controlling the movement of the main stage 130 in such a manner as to cause the image area of the intermediate transfer material 120 to register with the machine plate 136 by calculating the moving velocity of the machine plate 136. In addition, in this case, since the marks 300 and 302 indicating the image-area front end are formed outside the image area, the marks 300 and 302 are not transferred onto the machine plate 136, so that marks other than the desired image are not formed on the printed matter.

Figure 13:
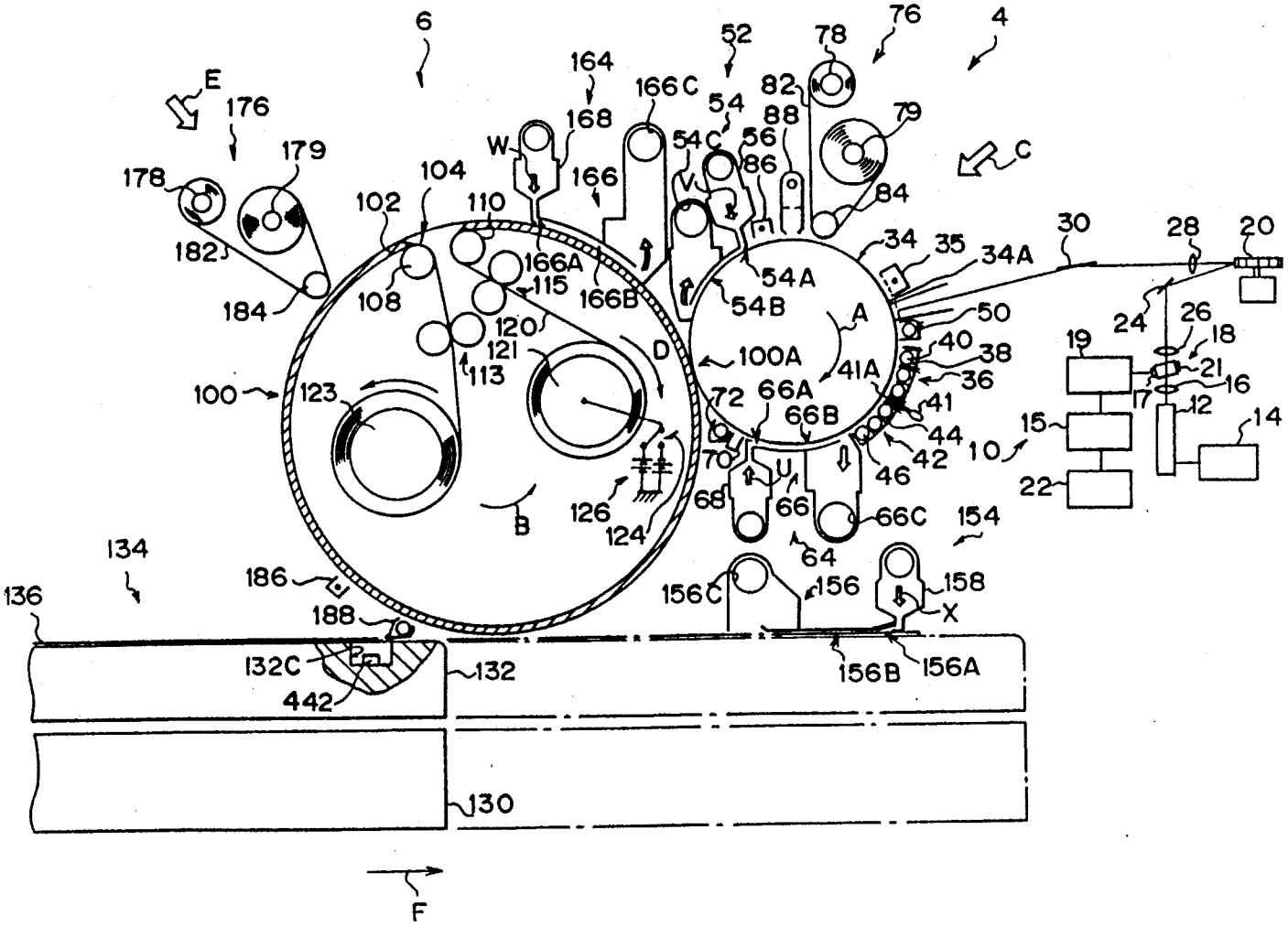
FIG. 13 is a schematic diagram illustrating the layout of various processing portions and a CCD image sensor which constitute an electrophotographic plate-making apparatus in accordance with a third embodiment.

Referring now to FIG. 13, a description will be given of a third embodiment of the present invention. It should be noted that the same component parts, members, and the like as those of the first embodiment will be denoted by the same reference numerals, and a description thereof will be omitted.

In the third embodiment, unlike the first embodiment, a CCD image sensor 442 is provided in the sub-stage 132. That is, a recessed accommodating portion 132C is formed in an upper portion of the sub-stage 132 at a position corresponding to the corner portion of the machine plate 136 at a forward end thereof in the advancing direction. The CCD image sensor 442 is placed on the bottom surface of the accommodating portion 132C with its detecting surface facing upward, and the CCD image sensor 442 is adapted to detect the mark 34B on the intermediate transfer material 120 and the corner portion of the machine plate 136 at the forward end thereof in the advancing direction. Accordingly, in the same way as the above-described first embodiment, the image can be transferred with the image area of the intermediate transfer material 120 registered with the machine plate 136.

It should be noted that the arrangement provided in the first, second, and third embodiments is such that the image area of the intermediate transfer material 120 is registered with the machine plate 136 by controlling the moving velocity of the main stage 130, the present invention is not restricted to the same, and the motor 118 for rotating the intermediate transfer drum 100 may be controlled in such a manner that the image area of the intermediate transfer material 120 is registered with the machine plate 136.

What is claimed is:

1. An electrophotographic plate-making apparatus for recording an image on a recording material, comprising:

a photoconductive sensitive material;

light-beam applying means for forming an image and a mark indicating a position of a first area corresponding to said image by applying a light beam onto a surface of said photoconductive sensitive material;

movable intermediate transfer means for transferring said image and said mark formed on said photoconductive sensitive material onto a surface of said transfer means;

moving means for moving said recording material;

detecting means for detecting said mark transferred onto said intermediate transfer means; and control means for controlling at least one of operation of said moving means and movement of said intermediate transfer means based on a detection signal of said detecting means in such a manner that said first area and a second area of said recording material where said image is to be recorded will be registered with each other, and for controlling operation of said moving means and movement of said intermediate transfer means while said surface of said intermediate transfer means and said recording material are brought into contact with each other, so as to transfer said image, transferred onto said surface of said intermediate transfer means, onto said recording material.

2. An electrophotographic plate-making apparatus to claim 1, wherein said light-beam applying means comprises a semiconductor laser optical system for applying a laser beam onto said surface of said photoconductive sensitive material.

3. An electro-photographic plate-making apparatus according to claim 2, wherein said semiconductor laser optical system comprises a semiconductor laser for oscillating a laser beam, image-information supplying means for generating signals of varying frequencies in response to image information, and an acoustic optical modulator, wherein the signals of varying frequencies generated by said image-information supplying means are supplied to said acoustic optical modulator, and when the laser beam oscillated by said semiconductor laser passes through said acoustic optical modulator, the laser beam being diffracted in different directions corresponding to the frequencies of the signals so as to effect scanning by a plurality of laser beams.

4. A electrophotographic plate-making apparatus according to claim 1, wherein said mark is formed at a boundary portion between said first image area and a non-image area.

5. A electrophotographic plate making apparatus according to claim 1, wherein said mark is formed in a non-image area of the surface of said photoconductive sensitive material

6. A electrophotographic plate-making apparatus according to claim 1, wherein said control means controls at least one of the movement in a moving direction at the time of transfer and the movement in a direction perpendicular to said moving direction, of at least one of said recording material and said intermediate transfer means.

7. A electro-photographic plate-making apparatus according to claim 1, wherein said detecting means is provided at a reference position, and said control means controls at least one of the operation of said moving means and the movement of said intermediate transfer means based on a distance from said reference position to a predetermined position on said recording material and a distance from said reference position to said mark.

8. A electrophotographic plate-making apparatus according to claim 1, said mark, comprising plurality of indicating marks formed at predetermined intervals along a direction of movement caused by said moving means.

9. A electrophotographic plate-making apparatus according to claim 8, wherein said control means calculates a moving velocity of said intermediate transfer means based on a time difference detected with respect to said plurality of marks and a respective dimension between said plurality of marks, and controls at least one of the operation of said moving means and the movement of said intermediate transfer means based on said moving velocity.

10. A electrophotographic plate-making apparatus according to claim 1, wherein said intermediate transfer means comprises a layered member having an electrically conductive layer provided on a film-like base and an insulating layer provided on an upper surface of said electrically conductive layer.

11. A electrophotographic plate-making apparatus according to claim 10, further comprising: an intermediate transfer drum including replacing means which is disposed inside said intermediate transfer drum and is adapted to hold said layered member over an outer peripheral portion of and inside said intermediate transfer drum and to replace a portion of said layered member located on the outer peripheral portion of said intermediate transfer drum with a portion of said layered member located inside said intermediate transfer drum, applying means for applying a bias voltage to said electrically conductive layer, and changeover means for changing over a polarity of said bias voltage.

12. A electrophotographic plate-making apparatus according to claim 11, wherein said intermediate transfer drum is constituted by a hollow member formed of a light-transmitting material, and said detecting means is adapted to effect said detection by means of light and is disposed in said intermediate transfer drum, said layered member being adapted to allow the light to be transmitted therethrough.

13. A electrophotographic plate-making apparatus according to claim 12, wherein said intermediate transfer drum is covered with a sheet-like resilient member whose outer peripheral surface is formed of a light-transmitting material.

14. An electrophotographic plate-making apparatus for recording an image on a recording material, comprising:

a photoconductive sensitive material;

light-beam applying means for forming an image and a mark indicating a position of a first area corresponding to said image by applying a light beam onto a surface of said photoconductive sensitive material;

movable intermediate transfer means for transferring said image and said mark formed on said photoconductive sensitive material onto a surface of said transfer means;

moving means for moving said recording material;

detecting means for detecting said mark transferred onto said intermediate transfer means and for detecting said recording material; and control means for controlling at least one of operation of said moving means and movement of said intermediate transfer means based on a detection signal of said detecting means in such a manner that said first area and a second area of said recording material where said image is to be recorded will be registered with each other, and for controlling operation of said moving means and movement of said intermediate transfer means while surface of said intermediate transfer means and said recording material are brought into contact with each other, so as to transfer said image, transferred onto said surface of said intermediate transfer means, onto said recording material.

15. An electrophotographic plate-making apparatus according to claim 14, wherein said light-beam applying means comprises a semiconductor laser optical system for applying a laser beam onto said surface of said photoconductive sensitive material.

16. An electrophotographic plate-making apparatus according to claim 15, wherein said semiconductor laser optical system comprises a semiconductor laser for oscillating a laser beam, image-information supplying means for generating signals of varying frequencies in response to image information, and an acoustic optical modulator, wherein the signals of varying frequencies generated by said image-information supplying means are supplied to said acoustic optical modulator, and when the laser beam oscillated by said semiconductor laser passes through said acoustic optical modulator, the laser beam is diffracted in different directions corresponding to the frequencies of the signals so as to effect scanning by a plurality of laser beams.

17. A electrophotographic plate-making apparatus according to claim 14, wherein said mark is formed at a boundary portion between said first image area and a non-image area.

18. A electrophotographic plate-making apparatus according to claim 14, wherein said control means controls at least one of movement in a moving direction at a time of transfer and movement in a direction perpendicular to said moving direction, of at lest one of said recording material and said intermediate transfer means.

19. A electrophotographic plate-making apparatus according to claim 14, wherein said intermediate transfer means comprises a layered member having an electrically conductive layer provided on a film-like base and an insulating layer provided on an upper surface of said electrically conductive layer.

20. A electrophotographic plate making apparatus according to claim 19, further comprising an intermediate transfer drum including replacing means which is disposed inside said intermediate transfer drum and is adapted to hold said layered member over an outer peripheral portion of and inside said intermediate transfer drum and to replace a portion of said layered member located on the outer peripheral portion of said intermediate transfer drum with a portion of said layered member located inside said intermediate transfer drum, applying means for applying a bias voltage to said electrically conductive layer, and changeover means for changing over a polarity of said bias voltage.

21. A electrophotographic plate-making apparatus according to claim 20, wherein said intermediate transfer drum is constituted by a hollow member formed of a light-transmitting material, and said detecting means is adapted to effect said detection by means of light and is disposed in said intermediate transfer drum, said layered member being adapted to allow the light to be transmitted therethrough.

22. A electrophotographic plate-making apparatus according to claim 20, wherein said intermediate transfer drum is covered with a sheet-like resilient member whose outer peripheral surface is formed of a light-transmitting material.

23. A electrophotographic plate making apparatus according to claim 14, wherein said detecting means is fixed to said moving means so that a forward end of said recording material in a moving direction thereof and said mark will fall under a range of detection.

* * * * *